US010394187B2

(12) United States Patent
Kimura et al.

(10) Patent No.: US 10,394,187 B2
(45) Date of Patent: Aug. 27, 2019

(54) EXPOSURE DEVICES, STATIC ELIMINATOR, AND IMAGE FORMING APPARATUS COMPRISING THE SAME

(71) Applicant: KYOCERA Document Solutions Inc., Osaka (JP)

(72) Inventors: Keigo Kimura, Osaka (JP); Hiroka Itani, Osaka (JP); Yoshiyuki Odaka, Osaka (JP); Hiroaki Watanabe, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/117,006

(22) Filed: Aug. 30, 2018

(65) Prior Publication Data

US 2019/0079450 A1 Mar. 14, 2019

(30) Foreign Application Priority Data

Sep. 8, 2017 (JP) ..... 2017-173453
Nov. 10, 2017 (JP) ..... 2017-217103

(51) Int. Cl.
*G03G 21/20* (2006.01)
*G03G 15/043* (2006.01)
*G03G 15/04* (2006.01)

(52) U.S. Cl.
CPC ..... *G03G 21/203* (2013.01); *G03G 15/043* (2013.01); *G03G 15/04036* (2013.01)

(58) Field of Classification Search
CPC ..... G03G 21/203; G03G 15/04036; G03G 15/043
See application file for complete search history.

(56) References Cited

U.S. PATENT DOCUMENTS

2005/0194525 A1* 9/2005 Saka ..... B41J 2/471 250/234
2017/0108793 A1* 4/2017 Kishi ..... G03G 15/043
2019/0079429 A1* 3/2019 Kawaguchi ..... G03G 15/043

FOREIGN PATENT DOCUMENTS

JP 2004-191790 A 7/2004
JP 2007-199379 A 8/2007

* cited by examiner

*Primary Examiner* — Rodney A Bonnette
(74) *Attorney, Agent, or Firm* — Studebaker & Brackett PC

(57) ABSTRACT

An image forming apparatus includes a photoreceptor and an exposure device. The exposure device is configured to expose a surface of the photoreceptor and to form an electrostatic latent image. The exposure device includes a light source, a polygon mirror and a polygon motor. The light source is configured to emit a beam. The polygon mirror is configured to deflect the beam emitted from the light source. The polygon motor is configured to rotate the polygon mirror. The polygon motor is rotated at least temporarily when an aging mode to remove moisture from the surface of the photoreceptor is executed.

13 Claims, 15 Drawing Sheets

FIG. 5

| | PRINTING MODE | | | | | AGING MODE | | IMAGE FLOW |
|---|---|---|---|---|---|---|---|---|
| | PRINTING SPEED | WRITING LINEAR SPEED [mm/s] | NUMBER OF BEAM (BEAM COUNT) | RESOLUTION [dpi] | ROTAION SPEED OF POLYGON MOTOR [rpm] | POLYGON MOTOR | ROTAION SPEED OF POLYGON MOTOR [rpm] | |
| Comparative Example 1 | FULL SPEED | 100 | 1 | 600 | 30,000 | NOT ROTATED | | ○ |
| Comparative Example 2 | FULL SPEED | 150 | 3 | 600 | 15,000 | NOT ROTATED | | × |
| Comparative Example 3 | HALF SPEED | 75 | 1 | 600 | 22,500 | NOT ROTATED | | × |
| Comparative Example 4 | 3/4 SPEED | 90 | 1 | 600 | 27,000 | NOT ROTATED | | × |
| Example 1 | FULL SPEED | 150 | 3 | 600 | 15,000 | ROTATED | 30,000 | ○ |
| Example 2 | HALF SPEED | 75 | 2 | 1200 | 11,000 | ROTATED | 30,000 | ○ |

IMAGE FLOW ○:NO IMAGE FLOW ON HALF IMAGE

IMAGE FLOW ×:IMAGE FLOW ON HALF IMAGE

FIG. 6

| | PRINTING MODE | | | | | AGING MODE | | | APPARATUS CONDITION | IMAGE FLOW |
|---|---|---|---|---|---|---|---|---|---|---|
| | PRINTING SPEED | WRITING LINEAR SPEED [mm/s] | NUMBER OF BEAM (BEAM COUNT) | RESOLUTION [dpi] | ROTAION SPEED OF POLYGON MOTOR [rpm] | POLYGON MOTOR | ROTAION SPEED OF POLYGON MOTOR [rpm] | RETRIAL | | |
| Comparative Example 1 | FULL SPEED | 100 | 1 | 600 | 30,000 | NOT ROTATED | | NOT EXECUTED | INITIAL STATE | ○ |
| Comparative Example 2 | FULL SPEED | 100 | 1 | 600 | 30,000 | NOT ROTATED | | EXECUTED | LONG-TERM USED STATE | ○ |
| Comparative Example 3 | FULL SPEED | 100 | 1 | 600 | 30,000 | NOT ROTATED | | NOT EXECUTED | LONG-TERM USED STATE | × |
| Example 1 | FULL SPEED | 100 | 1 | 600 | 30,000 | ROTATED | 30,000 | NOT EXECUTED | LONG-TERM USED STATE | ○ |

IMAGE FLOW ○:NO IMAGE FLOW ON HALF IMAGE

IMAGE FLOW ×:IMAGE FLOW ON HALF IMAGE

FIG. 7

| | PRINTING MODE | | | | | AGING MODE | | | RETURN TIME | APPARATUS CONDITION | IMAGE FLOW | DASH MARK |
|---|---|---|---|---|---|---|---|---|---|---|---|---|
| | PRINTING SPEED | WRITING LINEAR SPEED [mm/s] | NUMBER OF BEAM (BEAM COUNT) | RESOLUTION [dpi] | ROTAION SPEED OF POLYGON MOTOR [rpm] | POLYGON MOTOR | ROTAION SPEED OF POLYGON MOTOR [rpm] | RETRIAL | | | | |
| Comparative Example 1 | FULL SPEED | 100 | 1 | 600 | 30,000 | NOT ROTATED | | NOT EXECUTED | 4min. | INITIAL STATE | ○ | NOT OCCURRED |
| Comparative Example 2 | FULL SPEED | 100 | 1 | 600 | 30,000 | NOT ROTATED | | EXECUTED (3 TIMES) | 16min. | LONG-TERM USED STATE | ○ | NOT OCCURRED |
| Comparative Example 3 | FULL SPEED | 100 | 1 | 600 | 30,000 | NOT ROTATED | | NOT EXECUTED | 4min. | LONG-TERM USED STATE | × | NOT OCCURRED |
| Example 1 | FULL SPEED | 100 | 1 | 600 | 30,000 | ROTATED | 30,000 | NOT EXECUTED | 4min. | LONG-TERM USED STATE | ○ | OCCURRED |
| Example 2 | FULL SPEED | 100 | 1 | 600 | 30,000 | FIRST TIME: ROTATED RETRIAL: NOT ROTATED | 30,000 | EXECUTED (2 TIMES) | 12min. | LONG-TERM USED STATE | ○ | NOT OCCURRED |
| Example 3 | FULL SPEED | 100 | 1 | 600 | 30,000 | ROTATED | 50,000 (2min.) 30,000 (1min.) 2,000(1min.) | NOT EXECUTED | 4min. | LONG-TERM USED STATE | ○ | NOT OCCURRED |

IMAGE FLOW ○: NO IMAGE FLOW ON HALF IMAGE
IMAGE FLOW ×: IMAGE FLOW ON HALF IMAGE

EXPOSURE DEVICES, STATIC ELIMINATOR, AND IMAGE FORMING APPARATUS COMPRISING THE SAME

INCORPORATION BY REFERENCE

This application is based on and claims the benefit of priorities from Japanese Patent application No. 2017-173453, filed on Sep. 8, 2017 and Japanese Patent application No. 2017-217103, filed on Nov. 10, 2017 which are incorporated by reference in their entirety.

BACKGROUND

The present disclosure relates to an electrophotographic type image forming apparatus.

An electrophotographic type image forming apparatus conventionally forms an electrostatic latent image on a surface of a photoreceptor and develops the electrostatic latent image in a toner image by a development device.

The photoreceptor is formed by providing a photosensitive layer having a thickness of 10 micrometers to several 10 micrometers on a surface of a cylindrical substrate. The photoreceptor is classified into one of an organic photoreceptor, a selenium and arsenic photoreceptor, an amorphous silicon photoreceptor (hereinafter, called as "an a-Si photoreceptor") and so forth, depending on a main material forming the photosensitive layer. The organic photoreceptor is relatively inexpensive; however, frequent replacement is necessary because it is easily abraded. The selenium and arsenic photoreceptor has a longer life compared with the organic photoreceptor; however, it has a disadvantage of handling difficulty because it uses a toxic substance. On the other hand, although the a-Si photoreceptor is expensive more than the organic photoreceptor, it has an advantage of easily handling because it uses a nontoxic substance and is hard to be abraded to provide a long life (for example, five times or more of the life of the organic photoreceptor). However, because the a-Si photoreceptor is hard to be abraded, it is required to polish its surface by a polishing roller.

In the image forming apparatus using such a photoreceptor, a phenomenon called as "image flow" may occur depending on the use condition. The image flow is a phenomenon in which an image is blurred or a periphery of an image is spread. The image flow is caused because moisture in air is adsorbed on a surface of the photoreceptor and a surface resistance of the photoreceptor is lowered. On the surface of the photoreceptor, discharge product, such as nitrate ion and ammonium ion, generated by discharging of an electrical conductive member such as a charge roller is adhered. When the discharge product absorbs the moisture under a high humidity environment, the surface resistance of the photoreceptor is lowered. If the electrostatic latent image is formed under such a condition, the potential of the electrostatic latent image is leaked to its periphery to generate potential decreasing, and a boundary of the electrostatic latent image becomes unclear to cause the image flow.

The image flow occurs on the a-Si photoreceptor remarkably. This is because the surface of the a-Si photoreceptor is hard to be abraded even if a blade is pressed and the surface of the a-Si photoreceptor has a particle structure which easily absorbs the moisture. However, in the organic photoreceptor, if a dew condensation occurs on a surface of a member (for example, a charge roller and an intermediate transferring belt) with which the organic photoreceptor contacts and the surface of the member contains the moisture, the moisture is transferred to the surface of the organic photoreceptor to cause the image flow.

In order to eliminate the occurrence of the image flow, it is required to raise an apparatus inside temperature and to dry an apparatus inside. However, in recent years, it is difficult to raise the apparatus inside temperature because of improved technique for cooling the apparatus inside, and the image flow therefore easily occurs.

Then, in a conventional technique to eliminate the occurrence of the image flow, a supply amount of the toner to the photoreceptor from the development device is regulated depending on a rotation speed of the photoreceptor.

SUMMARY

In accordance with an aspect of the present disclosure, an image forming apparatus includes a photoreceptor and an exposure device. The exposure device is configured to expose a surface of the photoreceptor and to form an electrostatic latent image. The exposure device includes a light source, a polygon mirror and a polygon motor. The light source is configured to emit a beam. The polygon mirror is configured to deflect the beam emitted from the light source. The polygon motor is configured to rotate the polygon mirror. The polygon motor is rotated at least temporarily when an aging mode to remove moisture from the surface of the photoreceptor is executed.

In accordance with an aspect of the present disclosure, an image forming apparatus includes a photoreceptor, a static eliminator and a controller. The photoreceptor has a surface on which an electrostatic latent image is formed. The static eliminator includes a light emitting element configured to emit an elimination light to the surface of the photoreceptor and a limit resistor configured to limit a current flowing through the light emitting element. The controller is configured to execute an aging mode to remove moisture from the surface of the photoreceptor when a predetermined condition is satisfied. An electric power applied to the static eliminator in an execution of the aging mode is set to be larger than an electric power applied to the static eliminator in an execution of a normal printing.

The above and other objects, features, and advantages of the present disclosure will become more apparent from the following description when taken in conjunction with the accompanying drawings in which a preferred embodiment of the present disclosure is shown byway of illustrative example.

BRIEF DESCRIPTION OF THE DRAWINGS

FIG. 5 is a table showing a result of Experiment 1.

FIG. 6 is a table showing a result of Experiment 2.

FIG. 7 is a table showing a result of Experiment 3.

DETAILED DESCRIPTION

A First Embodiment

Hereinafter, with reference to the attached drawings, an image forming apparatus 1 according to a first embodiment of the present disclosure will be described. Arrows Fr, Rr, L, R, U and Lo suitably marked in each figure respectively indicate a front side, a rear side, a left side, a right side, an upper side and a lower side of the image forming apparatus 1.

First, an entire structure of the image forming apparatus 1 will be described. The image forming apparatus 1 is a multifunctional peripheral multiply containing a print function, a copying function and a facsimile function, for example.

Figure 1:
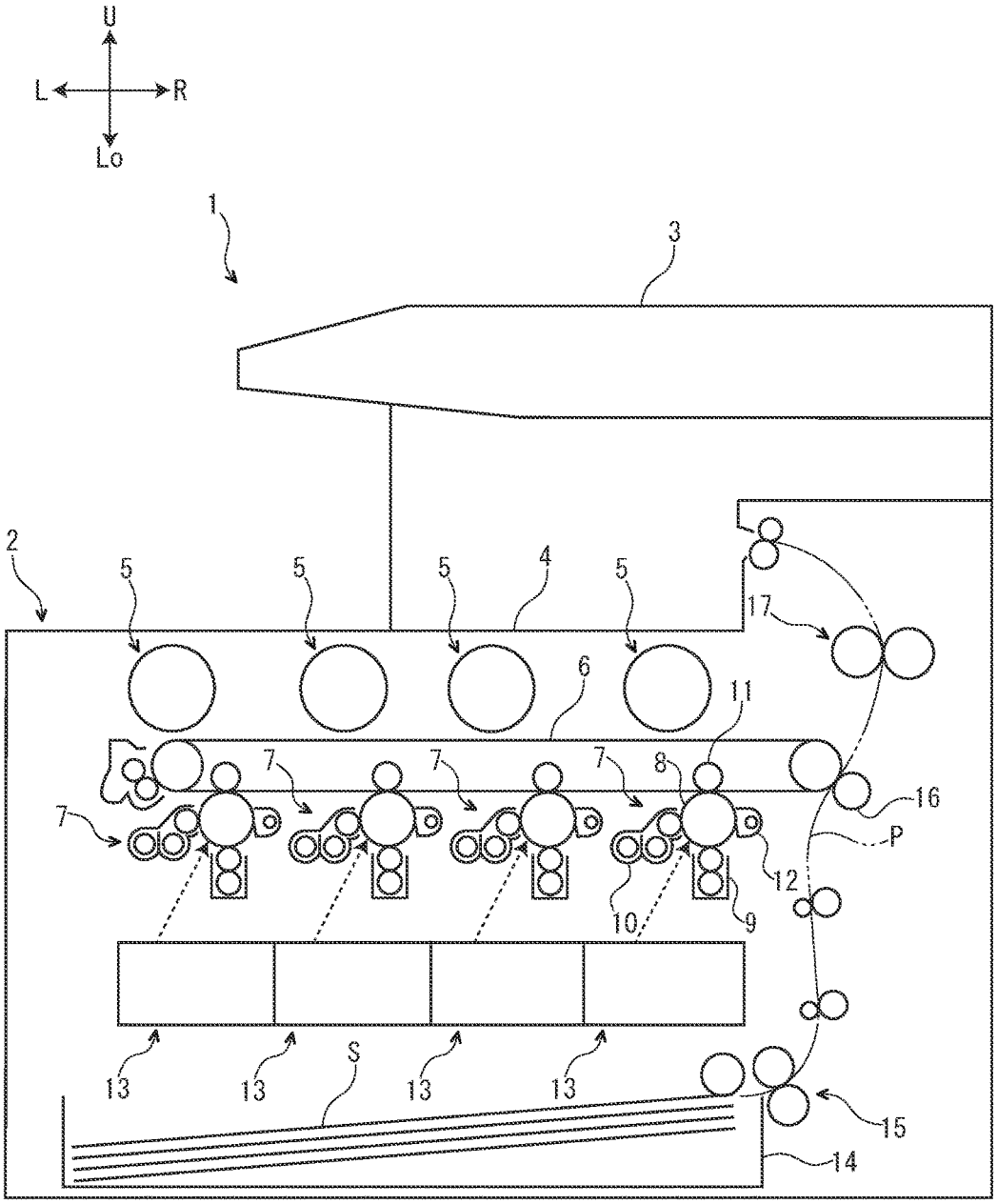
FIG. 1 is a schematic view showing an outline of an image forming apparatus according to a first embodiment of the present disclosure.

With reference to FIG. 1, the image forming apparatus 1 includes a box-shaped apparatus main body 2. At an upper end portion of the apparatus main body 2, an image reading device 3 configured to read an image of a document is provided. In an upper portion of the apparatus main body 2, an ejected sheet tray 4 is provided below the image reading device 3. In the upper portion of the apparatus main body 2, four toner containers 5 are provided below the ejected sheet tray 4. The four toner containers 5 respectively store toners of yellow, magenta, cyan and black.

In an approximately center portion of the apparatus main body 2, an intermediate transferring belt 6 (an example of a transferred body) is stored below the four toner containers 5. In the approximately center portion of the apparatus main body 2, four image forming parts 7 are stored below the intermediate transferring belt 6. The four image forming parts 7 respectively correspond to the toners of yellow, magenta, cyan and black. Each image forming part 7 includes a photosensitive drum 8 (an example of a photoreceptor), a charge device 9, a development device 10, a primary transferring roller 11 (an example of a transferring member) and a cleaning device 12.

In a lower portion of the apparatus main body 2, four exposure devices 13 are stored below the four image forming parts 7. In a lower end portion of the apparatus main body 2, a sheet feeding cassette 14 is stored below the four exposure devices 13. The sheet feeding cassette 14 stores sheets S.

In a right side portion of the apparatus main body 2, a conveying path P for the sheet S is provided. At an upstream portion of the conveying path P, a sheet feeding part 15 is provided. At a midstream portion of the conveying path P, a secondary transferring roller 16 is provided. At a downstream portion of the conveying path P, a fixing device 17 is provided.

Next, an operation of the image forming apparatus 1 having the above described configuration will be described.

First, the charge device 9 charges a surface of the photosensitive drum 8. Next, each exposure device 13 exposes the surface of the photosensitive drum 8 to form an electrostatic latent image on the surface of the photosensitive drum (refer to a dotted line arrow in FIG. 1). Next, the development device 10 develops the electrostatic latent image on the surface of the photosensitive drum 8 to a toner image. Next, the primary transferring roller 11 primarily transfers the toner image on the surface of the photosensitive drum 8 to a surface of the intermediate transferring belt 6. The above operation is performed at each image forming part 7 to form a full color toner image on the surface of the intermediate transferring belt 6. The toner remained on the surface of the photosensitive drum 8 is removed by the cleaning device 12.

On the other hand, the sheet S fed from the sheet feeding cassette 14 by the sheet feeding part 15 is conveyed to a downstream side along the conveying path P and enters a nip area between the intermediate transferring belt 6 and the secondary transferring roller 16. The secondary transferring roller 16 secondarily transfers the full color toner image on the surface of the intermediate transferring belt 6 to the sheet S. The sheet S on which the toner image is secondarily transferred is further conveyed to the downstream side along the conveying path P and enters the fixing device 17. The fixing device 17 fixes the toner image on the sheet S. The sheet S on which the toner image is fixed is ejected on the ejected sheet tray 4.

Next, each image forming part 7 will be further described.

Figure 2:
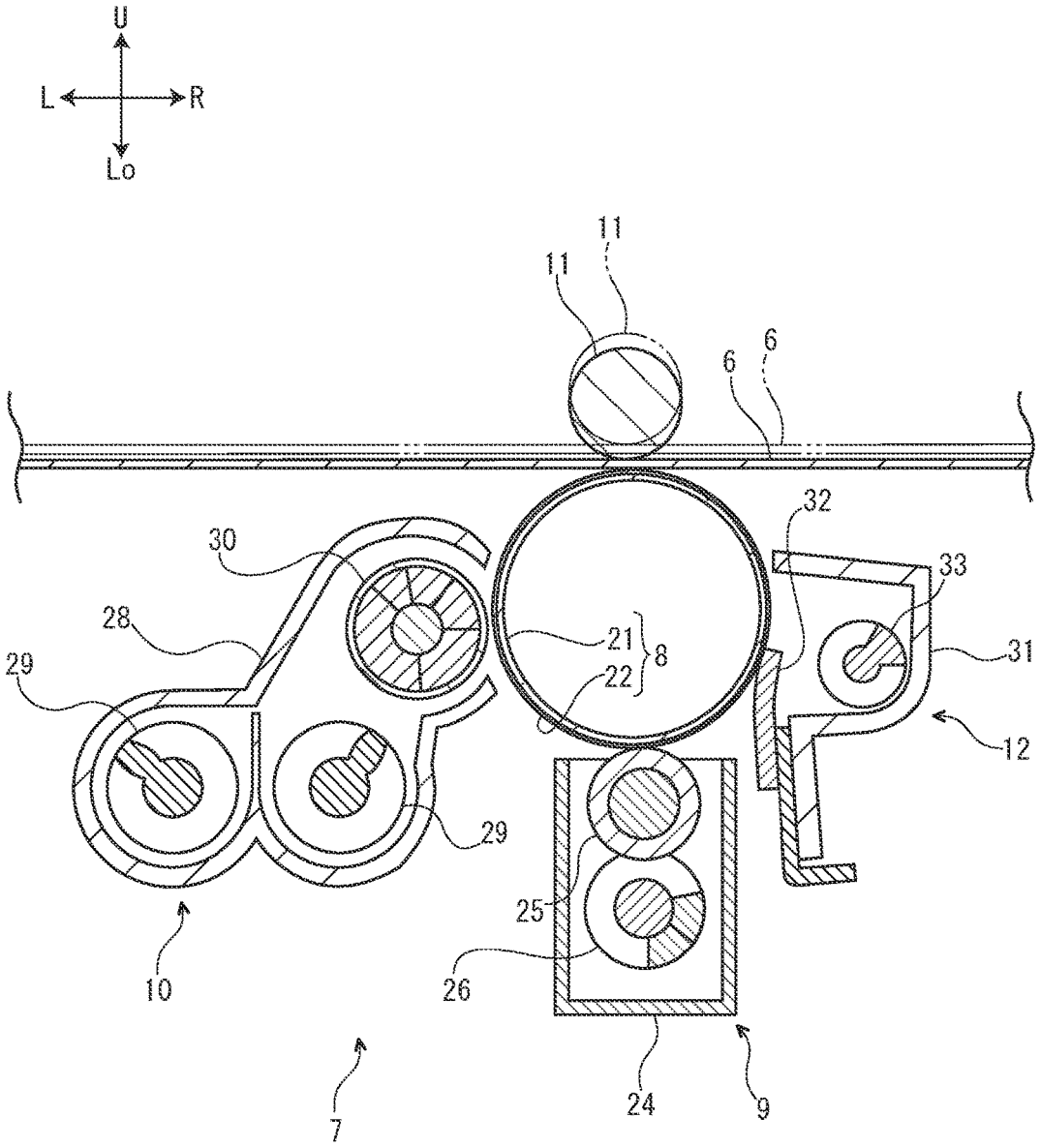
FIG. 2 is a sectional view showing an intermediate transferring belt and an image forming part according to the first embodiment of the present disclosure.

With reference to FIG. 2, each image forming part 7 includes the photosensitive drum 8, the charge device 9, the development device 10, the primary transferring roller 11 and the cleaning device 12, as described above.

The photosensitive drum 8 of each image forming part 7 includes a cylindrical substrate layer 21 and a photosensitive layer 22 covering a surface of the substrate layer 21. The substrate layer 21 is made of metal, such as aluminum and stainless steel, for example. The photosensitive layer 22 is made of amorphous silicon, for example. That is, the photosensitive drum 8 is composed of an amorphous silicon photoreceptor.

The charge device 9 of each image forming part 7 includes a holder 24, a charge roller 25 (a charge member) held in an upper portion of the holder 24 and a cleaning roller 26 held in a lower portion of the holder 24. A surface of the charge roller 25 comes into contact with the surface of the photosensitive drum 8. A surface of the cleaning roller 2 comes into contact with the surface of the charge roller 25.

The development device 10 of each image forming part 7 includes a casing 28, a pair of left and right agitating members 29 stored in a lower portion of the casing 28 and a development roller 30 stored in an upper portion of the casing 20. The casing 28 stores a developer. The developer is a two-component developer containing a non-magnetic toner and a magnetic carrier, for example.

Between the primary transferring roller 11 of each image forming part 7 and the photosensitive drum 8, the intermediate transferring belt 6 is put. The primary transferring roller 11 is movable between a first position (refer to a solid line in FIG. 2) where the surface of the intermediate transferring belt 6 is brought into contact with the surface of the photosensitive drum 8 and a second position (refer to a two-dotted chain line in FIG. 2) where the surface of the intermediate transferring belt 6 is separated from the surface of the photosensitive drum 8. As described, the intermediate transferring roller 6 is provided so as to be capable of coming into contact with and separating from the photosensitive drum 8.

The cleaning device 12 of each image forming part 7 includes a case 31, a blade 32 held by the case 31 and a collection screw 33 stored in the case 31. The blade 32 is made of polyurethane rubber, for example, and comes into contact with the surface of the photosensitive drum 8.

Next, each exposure device 13 will be further described.

Figure 3:
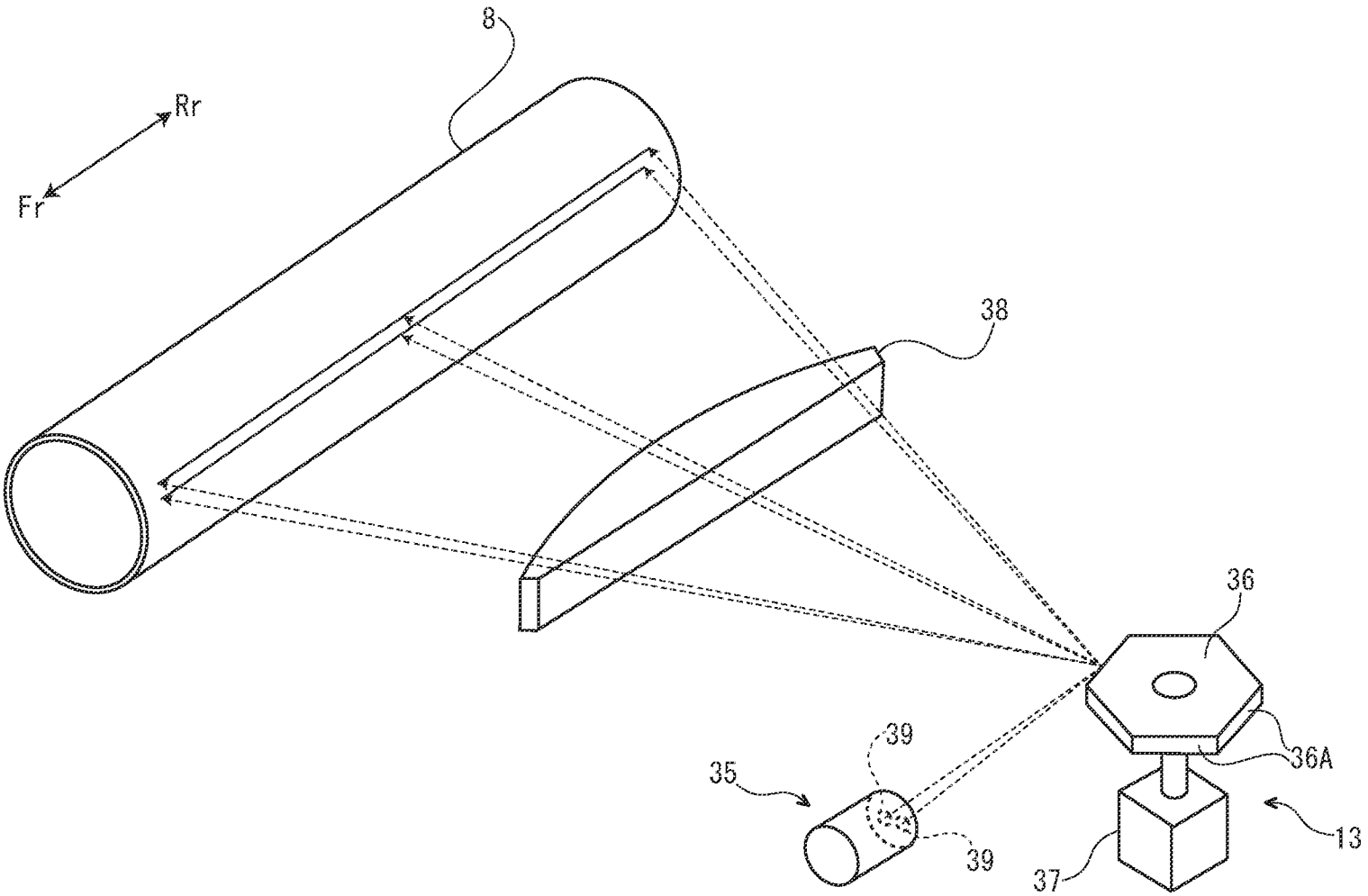
FIG. 3 is a perspective view showing a photosensitive drum and an exposure device according to the first embodiment of the present disclosure.

With reference to FIG. 3, each exposure device 13 includes an optical beam device 35, a polygon mirror 36, a polygon motor 37 and an optical lens 38.

The optical beam device 35 of each exposure device 13 includes two light sources 39. Each light source 39 is composed of a laser diode, for example, and is capable of emitting a beam (refer to a dotted line arrow in FIG. 3).

The polygon mirror 36 of each exposure device 13 is formed in a regular hexagonal shape. On an outer circumferential face of the polygon mirror 36, six reflection faces 36A are provided. The polygon mirror 36 is rotatable.

The polygon motor 37 of each exposure device 13 is fixed to the polygon mirror 36. The polygon motor 37 is rotated at a predetermined rotation speed to rotate the polygon mirror 36.

The optical lens 38 of each exposure device 13 is a fθ lens, for example. The optical lens 38 is provided between the polygon mirror 36 and the photosensitive drum 8. Each exposure device 13 includes a plurality of optical lenses (not shown) other than the optical lens 38.

Next, a control system of the image forming apparatus 1 will be described.

Figure 4:
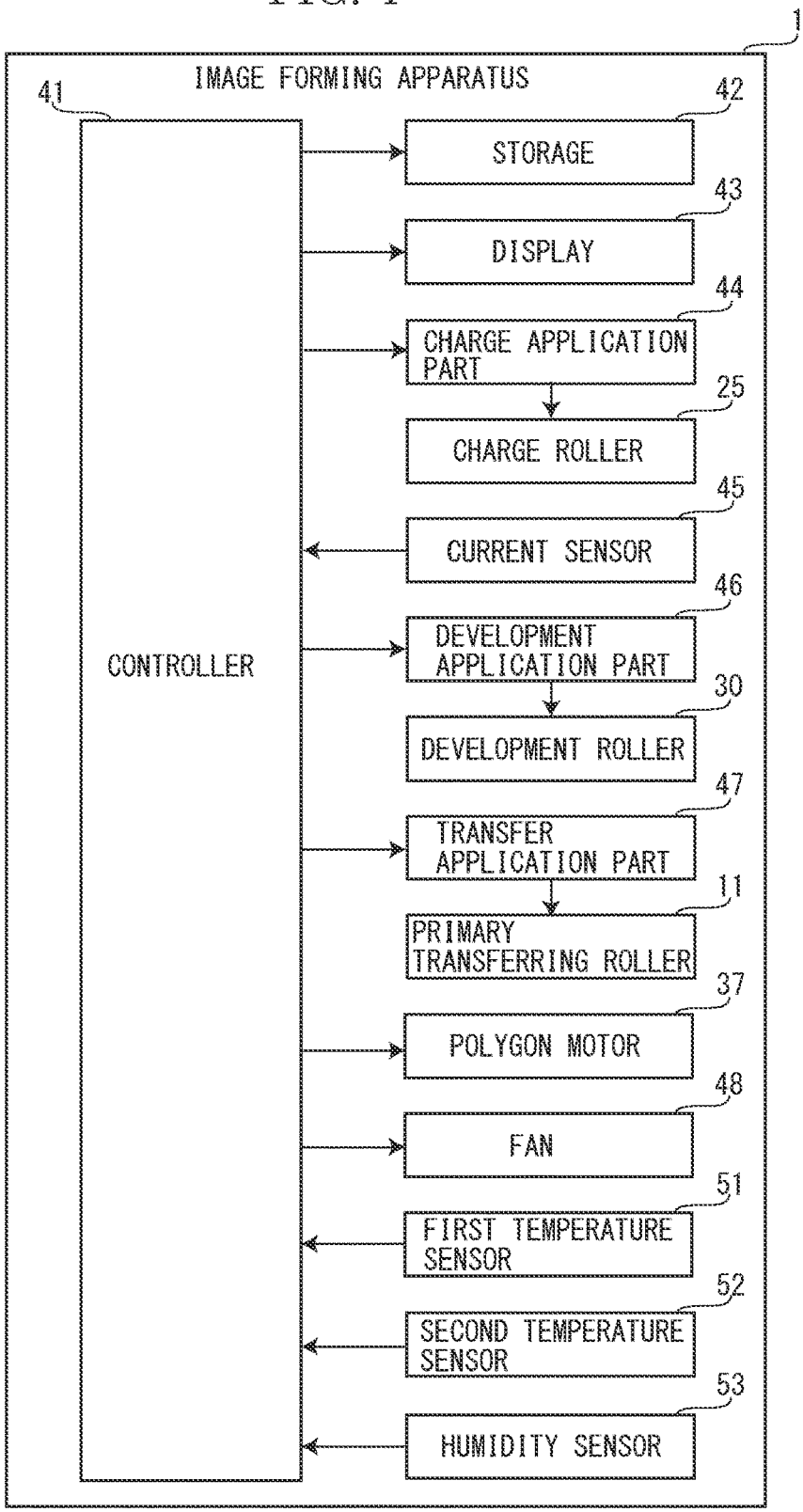
FIG. 4 is a block diagram showing a control system of the image forming apparatus according to the first embodiment of the present disclosure.

With reference to FIG. 4, the image forming apparatus 1 includes a controller 41. The controller 41 is composed of a central processing unit (CPU), for example. The controller 41 is connected to each part (for example, the image forming part 7) of the image forming apparatus 1 and controls each part of the image forming apparatus 1.

The controller 41 is connected to a storage 42. The storage 42 stores a control program and a data. The storage 41 includes a random access memory (RAM) and a read only memory (ROM).

The controller 41 is connected to a display 43. The display 43 is composed of a touch panel which displays various screens, such as an operation screen and a message screen.

The controller 41 is connected to a charge application part 44. The charge application part 44 applies a charge bias voltage to the charge roller 25. The charge bias voltage may be a bias voltage containing a DC component only or a bias voltage containing a DC component on which an AC component is superimposed. A polarity of the DC component of the charge bias voltage is the same as a charge polarity of the toner contained in the developer.

The controller 41 is connected to a current sensor 45. The current sensor 45 detects a value of current flowing through the charge roller 25 and outputs it to the controller 41.

The controller 41 is connected to a development application part 46. The development application part 46 applies a development bias voltage to the development roller 30. The development bias voltage is a bias voltage containing a DC component on which an AC component is superimposed.

The controller 41 is connected to a transfer application part 47. The transfer application part 47 applies a transfer bias voltage or an aging bias voltage to the primary transferring roller 11. The transfer bias voltage and the aging bias voltage may be a bias voltage containing a DC component only or a bias voltage containing a DC component on which an AC component is superimposed. A polarity of the DC component of the transfer bias voltage is reverse to the charge polarity of the toner contained in the developer. A polarity of the DC component of the aging bias voltage is the same as the charge polarity of the toner contained in the developer and reverse to the polarity of the DC component of the transfer bias voltage.

The controller 41 is connected to the polygon motor 37. The polygon motor 37 is rotated at the predetermined rotation speed based on a signal output from the controller 41 to rotate the polygon mirror 36.

The controller 41 is connected to a fan 48. The fan 48 is driven based on a signal output from the controller 41 to take air in an apparatus outside (an outside of the apparatus main body 2) into an apparatus inside (an inside of the apparatus main body 2).

The controller 41 is connected to a first temperature sensor 51 (an example a temperature sensor). The first temperature sensor 51 detects an apparatus inside temperature and outputs it to the controller 41.

The controller 41 is connected to a second temperature sensor 52 (an example another temperature sensor). The second temperature sensor 52 detects an apparatus outside temperature and outputs it to the controller 41.

The controller 41 is connected to a humidity sensor 53. The humidity sensor 53 detects apparatus outside humidity and outputs it to the controller 41.

Next, a printing mode to print an image on the sheet S will be described.

When the printing mode is executed, the primary transferring roller 11 is in the first position (refer to the solid line in FIG. 2). Then, the surface of the intermediate transferring belt 6 comes into contact with the surface of the photosensitive drum 8.

When the printing mode is executed, the charge application part 44 applies the charge bias voltage to the charge roller 25 to charge the charge roller 25. In addition, when the printing mode is executed, the photosensitive drum 8 is rotated, and the charge roller 25 which comes into contact with the photosensitive drum 8 is driven by the photosensitive drum 8 to be rotated. Thereby, the charge roller 25 charges the surface of the photosensitive drum 8 uniformly.

When the printing mode is executed, the polygon motor 37 is rotated at the predetermined rotation speed to rotate the polygon mirror 36. At this time, the rotation speed of the polygon motor 37 is selected among a plurality of rotation speeds.

When the printing mode is executed, each of the two light sources 39 emits a beam (refer to the dotted line arrow in FIG. 3). The beam emitted from each light source 39 is deflected by each reflection face 36A of the polygon mirror 36, passes through the optical lens 38 and then reaches the surface of the photosensitive drum 8. Thereby, the surface of the photosensitive drum 8 is exposed along two lines at the same time. By exposing of the surface of the photosensitive drum 8 in this manner, the electrostatic latent image is formed on the surface of the photosensitive drum 8.

When the printing mode is executed, each agitating member 29 is rotated to agitate the developer in the casing 28, and the developer is charged. In addition, when the printing mode is executed, the development roller 30 is rotated to convey the charged developer by the development roller 30. When the printing mode is executed, the development application part 46 applies the development bias voltage to the development roller 30. Thereby, the toner in the developer is supplied from the development roller 30 to the surface of the photosensitive drum 8 so that the electrostatic latent image on the surface of the photosensitive drum 8 is developed to the toner image.

When the printing mode is executed, the transfer application part 47 applies the transfer bias voltage to the primary transferring roller 11. Thereby, the toner image on the surface of the photosensitive drum 8 is primarily transferred on the surface of the intermediate transferring belt 6. The toner image primarily transferred on the surface of the intermediate transferring belt 6 is secondarily transferred on the sheet S by the secondary transferring roller 16.

Next, an aging mode to remove moisture from the surface of the photosensitive drum 8 will be described.

When a power source of the image forming apparatus 1 is turned on or when the image forming apparatus 1 is returned from a sleep mode, the first and second temperature sensors 51 and 52 respectively detect the apparatus inside temperature and the apparatus outside temperature, and the humidity sensor 53 detects the apparatus outside humidity. For example, when a difference between the apparatus inside temperature and the apparatus outside temperature is a predetermined threshold value or larger and the apparatus outside humidity is a predetermined threshold value or higher, the controller 41 decides that the image forming apparatus 1 is placed under a dew condensation environment (an environment where a dew condensation easily occurs). When the apparatus outside temperature is a predetermined threshold value or higher and the apparatus outside humidity is a predetermined threshold value or higher, the controller 41 decides that the image forming apparatus 1 is placed under a high temperature and high humidity environment (an environment where both the temperature and the humidity are high). When the controller 41 decides that the image forming apparatus 1 is placed under the dew condensation environment or the high temperature and high humidity environment, the following aging mode is automatically executed. The aging mode is manually executable by operating the display 43 by an operator such as a user or a service man.

When the aging mode is executed, the primary transferring roller 11 is in the second position (refer to the two-dotted chain line in FIG. 2). Then, the surface of the intermediate transferring belt 6 is separated from the surface of the photosensitive drum 8.

When the aging mode is executed, the charge application part 44 applies the charge bias voltage having an absolute value smaller than that of the voltage in the execution of the printing mode, to the charge roller 25 to charge the charge roller 25. In addition, when the aging mode is executed, the photosensitive drum 8 is rotated, and the charge roller 25 which comes into contact with the photosensitive drum 8 is driven by the photosensitive drum 8 to be rotated. Thereby, the charge roller 25 charges the surface of the photosensitive drum 8 uniformly.

When the aging mode is executed, the polygon motor 37 is rotated at the predetermined rotation speed to rotate the polygon mirror 36. At this time, a rotation speed of the polygon motor 37 is set to the fastest rotation speed among the plurality of rotation speeds which are selectable in the execution of the printing mode. When the aging mode is executed, the two light sources 39 do not emit the beam and the electrostatic latent image is not formed on the surface of the photosensitive drum 8.

When the aging mode is executed, the toner in the developer is supplied from the development roller 30 to the surface of the photosensitive drum 8 by the same operation as that in the execution of the printing mode. However, because the electrostatic latent image is not formed on the surface of the photosensitive drum 8 as described above, a toner belt (a belt-like shaped toner image formed continuously along a rotation axis direction of the photosensitive drum 8) is formed on the surface of the photosensitive drum 8.

When the aging mode is executed, the transfer application part 47 applies the aging bias voltage (the voltage having a polarity reverse to the transfer bias voltage) to the primary transferring roller 11. Thereby, the toner belt on the surface of the photosensitive drum 8 is passed through an opposing area of the primarily transferring roller 11 without primarily transferred to the intermediate transferring belt 6, enters the cleaning device 12 and then is removed by the blade 32. As a result, the moisture adhered to the surface of the photosensitive drum 8 is removed from the surface of the photosensitive drum 8 together with the toner belt. Hereinafter, the aging using such a toner belt is called as "a toner aging."

When the aging mode is executed, after the above toner aging is finished, the charge application part 44 applies the charge bias voltage to the charge roller 25 to make the charge roller 25 electrical conduct. This promotes heat generation of the photosensitive drum 8, and the moisture adhered to the surface of the photosensitive drum 8 is evaporated. Hereinafter, the aging using the electrical conduction of the charge roller 25 is called as "an electrical conduction aging." When the electrical conduction aging is executed, the toner in the developer is not supplied from the development roller 30 to the surface of the photosensitive drum 8.

A length of the toner belt in the toner aging and an execution period of the toner aging and the electrical conduction aging are suitably adjusted depending on the temperature and the humidity detected by the sensors 51 to 53 and a printing speed of the image forming apparatus 1. When it is not returned from a state where the image flow easily occurs even if the toner aging and the electrical conduction aging are executed (for example, when a value of the current detected by the current sensor 45 is a predetermined threshold value or larger even if the toner aging and the electrical conduction aging are executed), a retrial of the toner ageing and the electrical conduction aging are executed.

By the way, in the present embodiment, as described above, the two beams emitted from the two light sources 39 allow an exposure of the surface of the photosensitive drum 8 along two lines at the same time. By applying such a configuration, it becomes possible to increase a writing linear speed (a speed to write the electrostatic latent image on the photosensitive drum 8) while restricting an increase of the rotation speed of the polygon motor 37 rotating the polygon mirror 36. Accordingly, it becomes possible to easily respond to a high printing speed of the image forming apparatus 1.

On the other hand, when the increase of the rotation speed of the polygon motor 37 is restricted as described above, because the heat generation of the polygon motor 37 is inhibited and the apparatus inside temperature is hardly increased, the dew condensation may easily occur in the apparatus inside. Then, if the above aging mode is executed, it may not be returned from the state where the image flow easily occurs or a long time may be required to return from the state where the image flow easily occurs.

However, in the present embodiment, when the aging mode is executed, the polygon motor 37 is rotated. By applying such a configuration, it becomes possible to heat the polygon motor 37 and to promote the increase of the apparatus inside temperature so as to dry the apparatus inside. Thereby, the execution of the aging mode allows a rapid return from the state where the image flow easily occurs so that the occurrence of the image flow can be inhibited surely.

In addition, as described above, because the execution of the aging mode allows a rapid return from the state where the image flow easily occurs, it becomes possible to shorten a time required to execute the aging mode. Therefore, it becomes possible to shorten a waiting time of the user with the execution of the aging mode and to improve utility of the image forming apparatus 1. In addition, it becomes possible to decrease an amount of the toner used for the execution of the aging mode and to decrease a running cost of the image forming apparatus 1.

In addition, based on the detection results of the temperature sensors 51 and 52 and the humidity sensor 53, the aging mode is executed. By applying such a configuration, it becomes possible to surely detect that the image forming apparatus 1 is placed under the dew condensation environment or the high temperature and high humidity environment. Accordingly, it becomes possible to eliminate the image flow under the dew condensation environment and the high temperature and high humidity environment surely.

In addition, when the aging mode is executed, the rotation speed of the polygon motor 37 is set to the fastest rotation speed among the plurality of rotation speeds which are selectable in the execution of the printing mode. By applying such a configuration, it becomes possible to increase a heat amount of the polygon motor 37 and to dry the apparatus inside rapidly.

In addition, when the aging mode is executed, the surface of the intermediate transferring belt 6 is separated from the surface of the photosensitive drum 8. By applying such a configuration, it becomes possible to inhibit an occurrence of such a failure that a part of the toner belt is accidently transferred to the surface of the intermediate transferring belt 6 from the surface of the photosensitive drum 8 in the execution of the aging mode.

The aging mode includes the toner aging using the toner belt and the electrical conduction aging using the electrical conduction of the charge roller 25. By applying such a configuration, the execution of the aging mode allows a sure removal of the moisture from the surface of the photosensitive drum 8.

Modified Embodiment

In the present embodiment, when the aging mode is executed, the polygon motor 37 is always rotated. However, if the apparatus inside temperature increases excessively as the polygon motor 37 is rotated, a impact resilience of the blade 32 becomes large depending on a thermal property of the blade 32. Then, if the blade 32 presses the toner and an additive on the surface of the photosensitive drum 8 forcefully, the toner and the additive are adhered to the surface of the photosensitive drum 8 and an image failure called as a dash mark may occur.

Then, in another embodiment, when the aging mode is executed, based on the apparatus inside temperature detected by the first temperature sensor 51, a ON/OFF state of the rotation of the polygon motor 37 may be switched. For example, when the aging mode is executed, during a period when the apparatus inside temperature detected by the first temperature sensor 51 is lower than a predetermined threshold value, the rotation of the polygon motor 37 is switched to an ON state, and if the apparatus inside temperature detected by the first temperature sensor 51 increases to the predetermined threshold value or higher, the rotation of the polygon motor 37 may be switched from the ON state to an OFF state. By applying such a configuration, it becomes possible to inhibit the increase of the impact resilience of the blade 32 depending on the thermal property of the blade 32 and to eliminate the occurrence of the dash mark.

In still another embodiment, when the aging mode is executed, on the condition that the apparatus inside temperature detected by the first temperature sensor 51 is lower than a first predetermined threshold value and the apparatus outside temperature detected by the second temperature sensor 52 is a second predetermined threshold value or higher, the rotation speed of the polygon motor 37 may be decreased in a stepped manner. By applying such a configuration, it becomes possible to increase the apparatus inside temperature immediately and to improve dehumidifying effect. Therefore, it becomes possible to achieve the shortening a return time from the state where the image flow easily occurs and the eliminating the occurrence of the dash mark at the same time. In this case, based on the apparatus inside temperature detected by the first temperature sensor 51, the ON/OFF state of the rotation of the polygon motor 37 may be preferably switched.

In the present embodiment, the humidity sensor 53 detects the apparatus outside humidity. On the other hand, in other embodiments, the humidity sensor 53 may detect apparatus inside humidity.

In the present embodiment, the photosensitive drum 8 is composed of the amorphous silicon photoreceptor. On the other hand, in other embodiments, the photosensitive drum 8 may be composed of a photoreceptor other than the amorphous silicon photoreceptor, such as an organic photoreceptor.

In the present embodiment, a beam count of the exposure device 13 is two. On the other hand, in other embodiments, the beam count of the exposure device 13 may be one, or three or more. As the beam count of the exposure device 13 is increased, the number of exposable line at one time increases so that it becomes possible to easily respond to a high printing speed of the image forming apparatus 1.

In the present embodiment, the intermediate transferring belt 6 is the transferred body. On the other hand, in other embodiments, the sheet S may be the transferred body. In other words, in other embodiments, the toner on the surface of the photosensitive drum 8 may be directly transferred on the sheet S.

In the present embodiment, the image forming apparatus 1 is a multifunctional peripheral. On the other hand, in other embodiments, the image forming apparatus 1 may be a printer, a copying machine or a facsimile machine.

<Experiments>

As described later, experiments to demonstrate an effect of the image forming apparatus 1 according to the above embodiment were carried out.

<Experiment 1>

In Experiment 1, the aging mode was executed in a state where the image forming apparatus 1 was placed under the dew condensation environment, and after it was returned from the state where the image flow was easy to occur, an intermitting printing was performed for 60 minutes. The intermitting printing was performed at a frequency of one time every 10 minutes. In each intermitting printing, the printing mode was executed to transfer the toner image on the sheet S, and then the aging mode was executed. In each intermitting printing, the fan 48 was driven to take air in the apparatus outside into the apparatus inside. When the air in the apparatus outside was taken into the apparatus inside, since outside moisture was also taken into the apparatus inside, the image flow was easy to occur. That is, Experiment 1 was carried out under a state where the image flow was easy to occur.

After the above intermitting printing for 60 minutes was finished, a half image (an image of a printing rate of 50%) was transferred on the sheet S, and whether the image flow occurred on the sheet S or not was checked visually. A result of Experiment 1 is shown in FIG. 5.

With reference to FIG. 5, Comparative Examples 1 to 4 were carried out without rotating the polygon motor 37 in the aging mode. In contrast, Examples 1 and 2 were carried out with the polygon motor 37 rotating in the aging mode.

In Comparative Example 1, in the printing mode, a beam count of the exposure device 13 was set to one and the rotation speed of the polygon motor 37 was set to 30,000 rpm (the fastest rotation speed in the printing mode). Thereby, the heat generation of the polygon motor 37 was promoted and the apparatus inside temperature was increased. As a result, the image flow did not occur. In contrast, in Comparative Example 2, in the printing mode, the beam count of the exposure device 13 was set to three and the rotation speed of the polygon motor 37 was set to 15,000 rpm (a rotation speed slower than the fastest rotation speed in the printing mode). Thereby, the heat generation of the polygon motor 37 was inhibited and the apparatus inside temperature was hardly increased. As a result, the image flow occurred. In Comparative Examples 3 and 4, in the printing mode, the beam count of the exposure device 13 was set to one and the rotation speed of the polygon motor 37 was respectively set to 22,500 rpm and 27,000 rpm (the rotation speeds slower than the fastest rotation speed in the printing mode). In these cases, the image flow occurred as with Comparative Example 2.

In contrast, in Example 1, in the printing mode, the beam count of the exposure device 13 was set to three and the rotation speed of the polygon motor 37 was set to 15,000 rpm. This is the same condition as Comparative Example 2. However, in Example 1, different from Comparative Example 2, the polygon motor 37 was rotated at the rotation speed of 30,000 rpm (the fastest rotation speed in the printing mode) in the aging mode. Thereby, the heat generation of the polygon motor 37 was promoted and the apparatus inside temperature was increased. As a result, the image flow did not occur.

In Example 2, in the printing mode, the beam count of the exposure device 13 was set to two and the rotation speed of the polygon motor 37 was set to 11,000 rpm further slower than that in Example 1. In Example 2, as with Example 1, the polygon motor 37 was rotated at the rotation speed of 30,000 rpm in the aging mode. Thereby, the heat generation of the polygon motor 37 was promoted and the apparatus inside temperature was increased. As a result, the image flow did not occur.

From the results of Experiment 1, it is demonstrated that in the state where the image forming apparatus 1 is placed under the dew condensation environment, by rotating the polygon motor 37 in the aging mode, it can be rapidly returned from the state where the image flow easily occurs. Additionally, it is also demonstrated that in the state where the image forming apparatus 1 is placed under the dew condensation environment, by setting the rotation speed of the polygon motor 37 in the aging mode to the fastest rotation speed in the printing mode, it becomes possible to eliminate the occurrence of the image flow surely.

<Experiment 2>

In Experiment 2, after the printing mode and the aging mode were executed in a state where the image forming apparatus 1 was placed under the high temperature and high humidity environment, the half image was transferred on the sheet S, and whether an image flow occurred on the sheet S or not was checked visually. A result of the Experiment 2 is shown in FIG. 6.

With reference to FIG. 6, in Comparative Examples 1 to 3, the polygon motor 37 was not rotates in the aging mode. In contrast, in Example 1, the polygon motor 37 was rotated in the aging mode.

In Comparative Example 1, the image forming apparatus 1 was in an initial state (a state just after a use of the image forming apparatus 1 was started). Thereby, the image flow did not occur. In Comparative Example 2, although the image forming apparatus 1 was in a long-term used state (a state where a long time passed after the use was started), a retrial of the aging mode was executed. Thereby, the image flow did not occur. In contrast, in Comparative Example 3, the image forming apparatus 1 was in the long-term used state and the retrial of the aging mode was not executed. Thereby, the image flow occurred.

In contrast, in Example 1, the image forming apparatus 1 was in the long-term used state and the retrial of the aging mode was not executed. This was the same condition as Comparative Example 3. However, different from Comparative Example 3, in the aging mode, the polygon motor 37 was rotated at a rotation speed of 30,000 rpm (the fastest rotation speed in the printing mode). Thereby, the heat generation of the polygon motor 37 was promoted and the apparatus inside temperature was increased. As a result, the image flow did not occur.

The result of Experiment 2 demonstrates that in the state where the image forming apparatus 1 is placed under the high temperature and high humidity environment, by rotating the polygon motor 37 in the aging mode, it can be rapidly returned from the state where the image flow easily occurs. It is also demonstrated that in the state where the image forming apparatus 1 is placed under the high temperature and high humidity environment, by setting the rotation speed of the polygon motor 37 in the aging mode to the fastest rotation speed in the printing mode, it becomes possible to eliminate the occurrence of the image flow surely.

<Experiment 3>

In Experiment 3, after the printing mode and the aging mode were executed in a state where the image forming apparatus 1 was placed under a high temperature and high humidity environment where the temperature and the humidity were higher than those in Experiment 2, the half image was transferred on a sheet S, and whether an image flow and the dash mark occurred on the sheet S or not was checked visually. A result of the Experiment 3 is shown in FIG. 7.

With reference to FIG. 7, in Comparative Examples 1 to 3, the polygon motor 37 was not rotated in the aging mode. In contrast, in Example 1 to 3, the polygon motor 37 was rotated in the aging mode.

In Comparative Example 1, the image forming apparatus 1 was in the initial state. Thereby, the image flow did not occur. In Comparative Example 2, although the image forming apparatus 1 was in the long-term used state, a retrial of the aging mode was executed for 32 times. Thereby, the image flow did not occur. In contrast, in Comparative Example 3, the image forming apparatus 1 was in the long-term used state and the retrial of the aging mode was not executed. Thereby, the image flow occurred.

In contrast, in Example 1, the image forming apparatus 1 was in the long-term used state and the retrial of the aging mode was not executed. This was the same condition as Comparative Example 3. However, different from Comparative Example 3, in the aging mode, the polygon motor 37 was rotated at the rotation speed of 30,000 rpm (the fastest rotation speed in the printing mode). Thereby, the heat generation of the polygon motor 37 was promoted and the apparatus inside temperature was increased. As a result, the image flow did not occur. However, in Example 1, with the increase of the apparatus inside temperature, the dash mark occurred.

In contrast, in Example 2, the image forming apparatus 1 was in the long-term used state and the retrial of the aging mode was executed for 21 times. In Example 2, although the polygon motor 37 was rotated in the execution of the first aging mode because the apparatus inside temperature was lower than the predetermined threshold value (38° C.), the rotation of the polygon motor 37 was stopped in the execution of the retrial of the aging mode because the apparatus inside temperature was the predetermined threshold value (38° C.) or higher. That is, in Example 2, the ON/OFF state of the rotation of the polygon motor 37 was switched based on the apparatus inside temperature in the execution of the aging mode. Thereby, although the number of the retrial was smaller than that in Comparative Example 2, both the image flow and the dash mark did not occur.

In Example 3, the image forming apparatus 1 was in the long-term used state and the retrial of the aging mode was not executed. In Example 3, in the execution of the aging mode, because the apparatus inside temperature was lower than the predetermined first threshold value (38° C.) and the apparatus outside temperature was the predetermined second value (28° C.) or higher, the rotation speed of the polygon motor 37 was set to 50,000 rpm (a rotation speed higher than the fastest rotating speed in the printing mode) for the first 2 minutes, then the rotation speed of the polygon motor 37 was set to 30,000 rpm (the fastest rotation speed in the printing mode) for the next 1 minute, and then the rotation speed of the polygon motor 37 was set to 2,000 rpm (a rotation speed slower the fastest rotation speed in the printing mode) for the last 1 minute. That is, in Example 3, the rotation speed of the polygon motor 37 was decreased in a stepped manner. Thereby, although the retrial of the aging mode was not executed, both the image flow and the dash mark did not occur.

The result of Experiment 3 (especially, Example 2) demonstrates that by switching the ON/OFF state of the rotation of the polygon motor 37 based on the apparatus inside temperature in the executing of the aging mode, it becomes possible to eliminate the occurrence of the dash mark and to shorten the return time from the state where the image flow easily occurs. The result of Experiment 3 (especially, Example 3) demonstrates that by decreasing the rotation speed of the polygon motor 37 in the execution of the aging mode in a stepped manner, it becomes possible to eliminate the occurrence of the dash mark and to further shorten the return time from the state where the image flow easily occurs.

A Second Embodiment

Hereinafter, with reference to the attached drawings, an image forming apparatus 101 according to a second embodiment of the present disclosure will be described. Arrows Fr, Rr, L, R, U and Lo suitably marked in each figure respectively indicate a front side, a rear side, a left side, a right side, an upper side and a lower side of the image forming apparatus 101.

First, an entire structure of the image forming apparatus 101 will be described. The image forming apparatus 101 is a multifunctional peripheral multiply containing a print function, a copying function and a facsimile function, for example.

Figure 8:
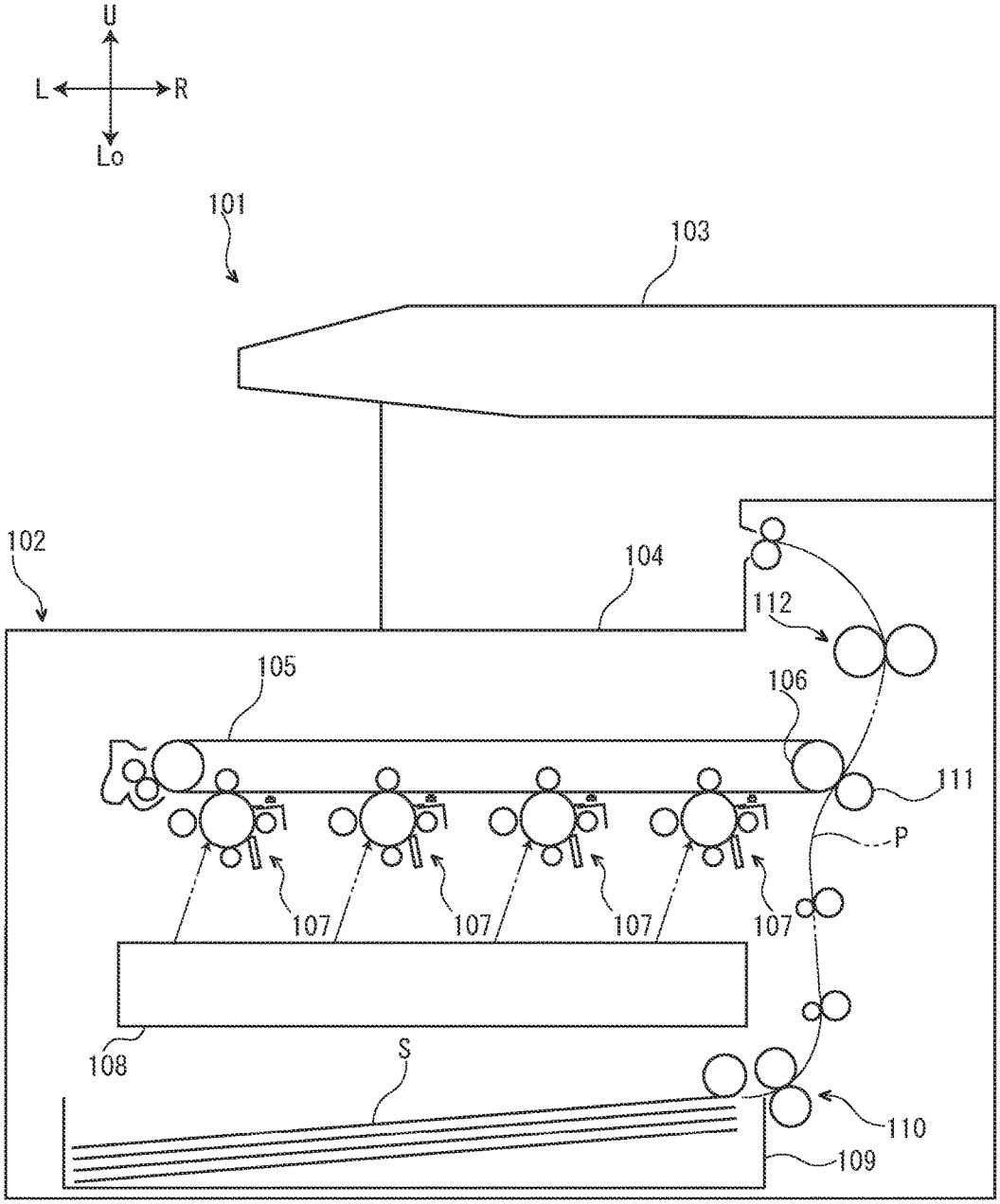
FIG. 8 is a schematic view showing the image forming apparatus according to a second embodiment of the present disclosure.

As shown in FIG. 8, the image forming apparatus 101 includes a box-shaped apparatus main body 102. At an upper end portion of the apparatus main body 102, an image reading device 103 configured to read an image of a document is provided. In an upper portion of the apparatus main body 102, an ejected sheet tray 104 is provided. In an approximately center portion of the apparatus main body 102, an intermediate transferring belt 105 is stored. A right end portion of the intermediate transferring belt 105 is wound around a drive roller 106. In the approximately center portion of the apparatus main body 102, four image forming parts 107 are stored below the intermediate transferring belt 105. The four image forming parts 107 respectively correspond to toners of black, cyan, magenta and yellow. In a lower portion of the apparatus main body 102, an exposure device 108 is stored. In a lower end portion of the apparatus main body 102, a sheet feeding cassette 109 configured to store sheets S (recording media) is stored.

In a right side portion of the apparatus main body 102, a conveying path P for the sheet S is provided. At an upstream portion of the conveying path P, a sheet feeding part 110 is provided. At a midstream portion of the conveying path P, a secondary transferring roller 111 is provided. At a downstream portion of the conveying path P, a fixing device 112 is provided.

Next, an operation of the image forming apparatus 101 will be described.

First, light (refer to a two-dotted chain line arrow in FIG. 8) emitted from the exposure device 108 forms an electrostatic latent image in each image forming part 107. The electrostatic latent image is developed to a toner image in each image forming part 107. The toner image is primarily transferred from each image forming part 107 to the intermediate transferring belt 105. Thereby, a full color toner image is formed on the intermediate transferring belt 105.

On the other hand, the sheet S fed from the sheet feeding cassette 109 by the sheet feeding part 110 is conveyed to a downstream side along the conveying path P and then enters a nip region between the intermediate transferring belt 105 and the secondary transferring roller 111. The secondary transferring roller 111 secondarily transfers the full color toner image on the intermediate transferring belt 6 to the sheet S. The sheet S on which the toner image is secondarily transferred is further conveyed to the downstream side along the conveying path P and then enters the fixing device 112. The fixing device 112 fixes the toner image on the sheet S. The sheet S on which the toner image is fixed is ejected on the ejected sheet tray 104.

Next, the image forming part 107 will be further described.

Figure 9:
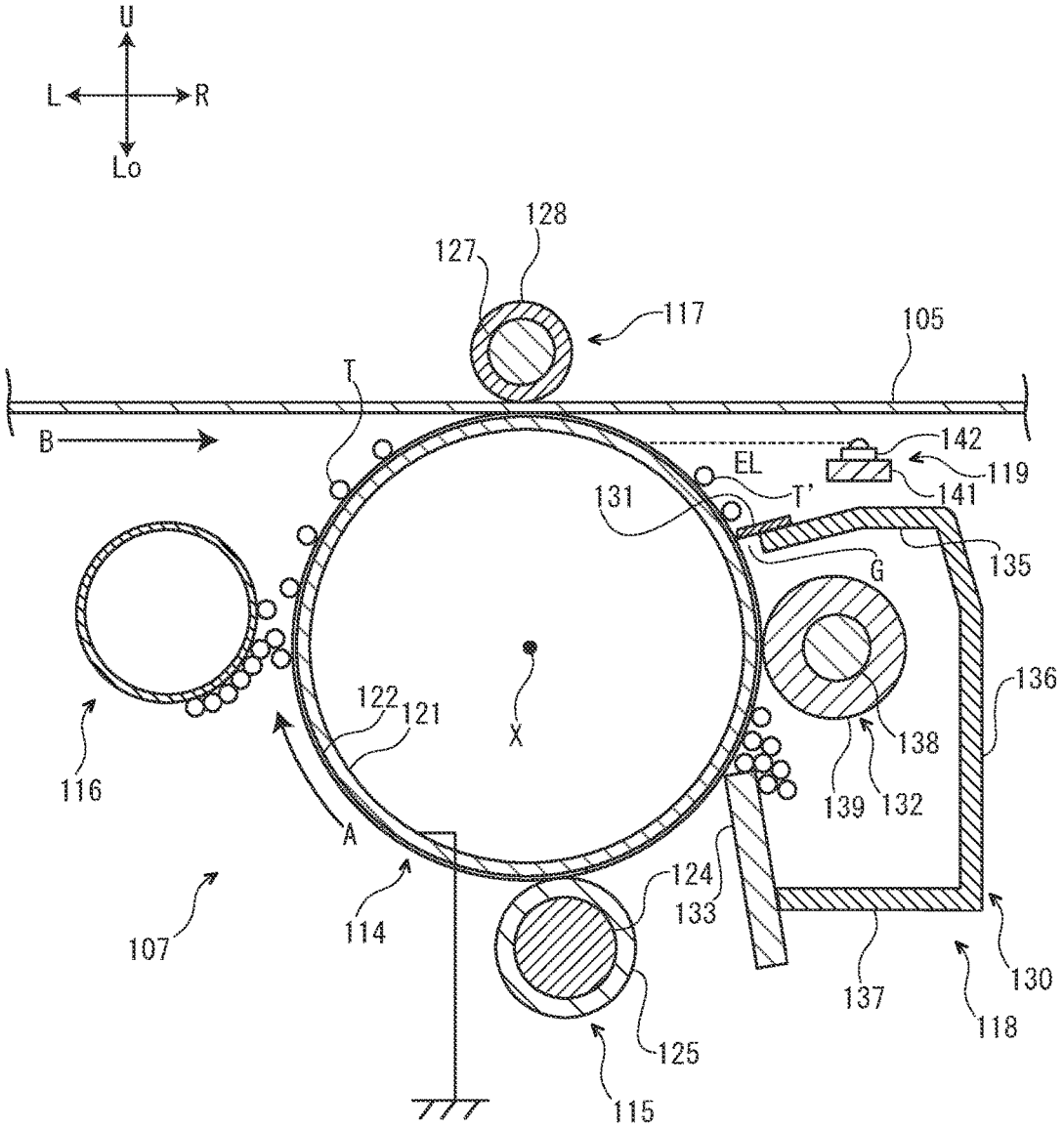
FIG. 9 is a sectional view showing the image forming part according to the second embodiment of the present disclosure.

With reference to FIG. 9, the image forming part 107 includes a photosensitive drum 114, a charge roller 115 (an example of a charge member) provided at a lower side of the photosensitive drum 114, a development roller 116 (an example of a development member) provided at a left side of the photosensitive drum 114, a primary transferring roller 117 provided at an upper side of the photosensitive drum 114, a cleaning device 118 provided at a right side of the photosensitive drum 114 and a static eliminator 119 provided at a right upper side of the photosensitive drum 114.

The photosensitive drum 114 of the image forming part 107 has a cylindrical shape. The photosensitive drum 114 is rotatable around a rotation axis X extending along the front-and-rear direction. That is, in the present embodiment, the front-and-rear direction is a rotation axis direction of the photosensitive drum 114. An arrow A in FIG. 9 indicates a rotation direction of the photosensitive drum 114.

The photosensitive drum 114 includes a substrate layer 121 and a photosensitive layer 122 covering an outer circumference of the substrate layer 121. The substrate layer 121 is made of metal, for example, and grounded electrically. The photosensitive layer 122 is made of amorphous silicon, for example. Hereinafter, a surface of the photosensitive layer 122 is called as "a surface of the photosensitive drum 114."

The charge roller 115 of the image forming part 107 has a columnar shape. The charge roller 115 is rotatable. The charge roller 115 includes a core metal 124 and an elastic layer 125 covering an outer circumference of the core metal 124. The core metal 124 is made of metal, for example. The elastic layer 125 is made of elastic material, such as epichlorohydrin rubber, and has electric conductivity. An outer circumferential face of the elastic layer 125 comes into contact with the surface of the photosensitive drum 114.

The development roller 116 of the image forming part 107 has a cylindrical shape. The development roller 116 is rotatable. An outer circumferential face of the development roller 116 faces the surface of the photosensitive drum 114 at an interval. Inside the development roller 116, a plurality of nonrotatable magnetic poles (not shown) are stored.

The intermediate transferring belt 105 is put between the primary transferring roller 117 of each image forming part 107 and the photosensitive drum 114. The primary transferring roller 117 is rotatable. The primary transferring roller 117 includes a core metal 127 and an elastic layer 128 covering an outer circumference of the core metal 127. The core metal 127 is made of metal, for example. The elastic layer 128 is made of elastic material, such as ethylene propylene rubber (EPDM), and has electric conductivity.

The cleaning device 118 of the image forming part 107 includes a housing 130, a seal member 131 fixed to a left upper portion of the housing 130, a rubbing roller 132 stored in the housing 130 and a blade 133 provided at a left lower side of the rubbing roller 132.

The housing 130 of the cleaning device 118 is opened to a left side (a side of the photosensitive drum 114), and is formed in an approximately U-shaped cross section. The housing 130 includes an upper wall 135 extending along the left-and-right direction, a side wall 136 bent to a lower side from a right end portion of the upper wall 135 and a bottom wall 137 bent to a left side from a lower end portion of the side wall 136. A left end portion of the upper wall 135 faces the surface of the photosensitive drum 114 at an interval G.

The seal member 131 of the cleaning device 118 is made of urethane sheet, for example. A base end portion of the seal member 131 is fixed to the left end portion of the upper wall 135 of the housing 130. A tip end portion of the seal member 131 comes into contact with the surface of the photosensitive drum 114. The seal member 131 covers the interval G between the left end portion of the upper wall 135 of the housing 130 and the surface of the photosensitive drum 114.

The rubbing roller 132 of the cleaning device 118 is stored in the housing 130. The rubbing roller 132 is rotatable. The rubbing roller 132 is arranged at the downstream side from the seal member 131 in the rotation direction of the photosensitive drum 114. The rubbing roller 132 includes a core metal 138 and an elastic layer 139 covering an outer circumference of the core metal 138. The core metal 138 is made of metal, for example. The elastic layer 139 is made of elastic material, such as ethylene propylene rubber (EPDM), for example.

The blade 133 of the cleaning device 118 is made of urethane rubber, for example. The blade 133 is fixed to a left end portion of the bottom wall 137 of the housing 130. The blade 133 is arranged at the downstream side from the rubbing roller 132 in the rotation direction of the photosensitive drum 114. A tip end portion of the blade 133 comes into contact with the surface of the photosensitive drum 114.

The static eliminator 119 of the image forming part 107 is arranged between a lower face of the intermediate transferring belt 105 and an upper face of the upper wall 135 of the housing 130 of the cleaning device 118. The static eliminator 119 is arranged at the downstream side from the primary transferring roller 117 and at the upstream side from the cleaning device 118 in the rotation direction of the photosensitive drum 114.

Figure 10:
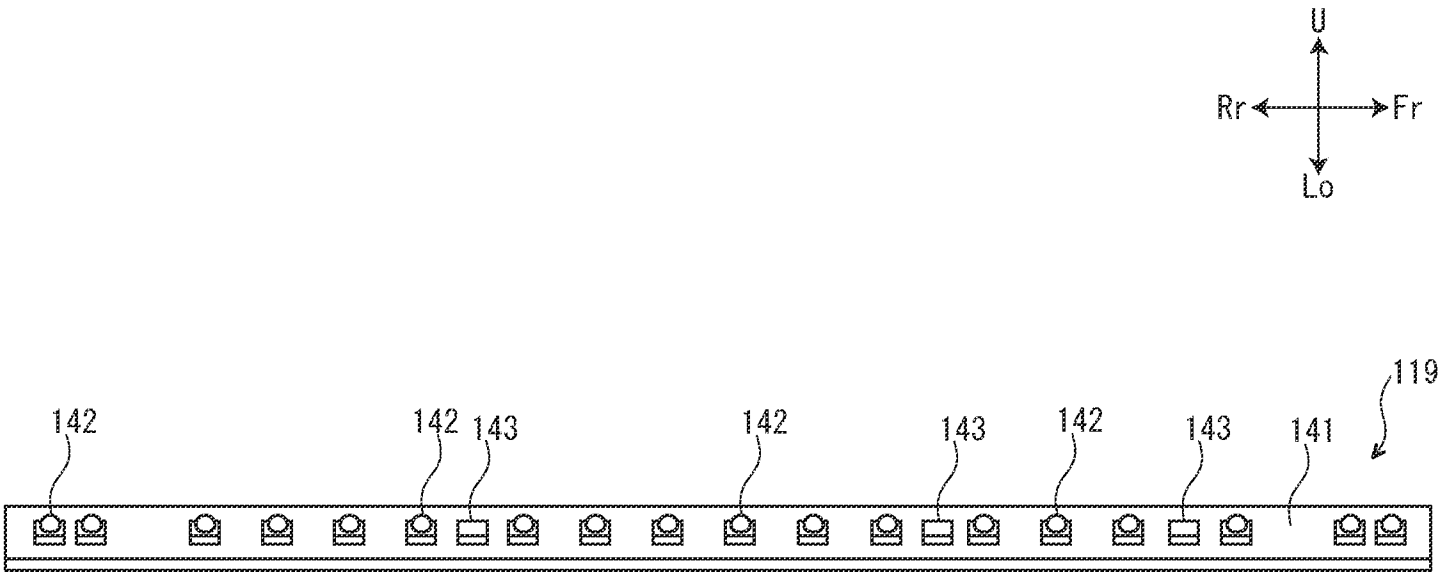
FIG. 10 is a perspective view showing a static eliminator according to the second embodiment of the present disclosure.

With reference to FIG. 10, the static eliminator 119 includes a board 141, a plurality of (for example, 18) light emitting elements 142 mounted on an upper face of the board 141 and a plurality of (for example, 3) limit resistors 143 mounted on the upper face of the board 141. The board 141 has a flat plate shape elongated in the front-and-rear direction. The plurality of light emitting elements 142 and the plurality of limit resistors 143 are each aligned in a line along the front-and-rear direction. Each light emitting elements 142 is composed of a chip type light emitting diode (LED), for example. Each limit resistor 143 is composed of a chip type resistor, for example.

Figure 11:
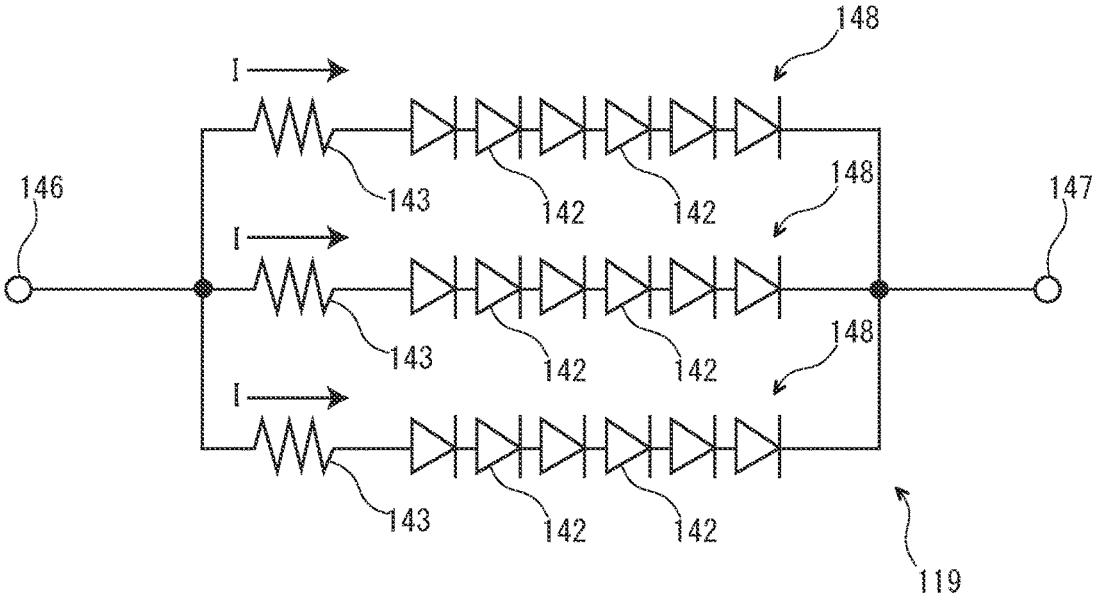
FIG. 11 is a circuit diagram showing the static eliminator according to the second embodiment of the present disclosure.

With reference to FIG. 11, one end portion of the static eliminator 119 is connected to a first electric power receiving terminal 146 and the other end portion of the static eliminator 119 is connected to a second electric power receiving terminal 147. The static eliminator 119 includes three eliminator units 148 connected in parallel to each other. Each eliminator unit 148 includes six light emitting elements 142 connected in series to each other and one limit resistor 143 connected in series to the six light emitting elements 142. In a direction (refer to an arrow I in FIG. 11) along which a current flows through each eliminator unit 148, each limit resistor 143 is arranged at an upstream side from each light emitting elements 142. Each limit resistor 143 limits a current flowing through each light emitting element 142 to protect each light emitting element 142.

Next, a control system of the image forming apparatus 101 will be described.

Figure 12:
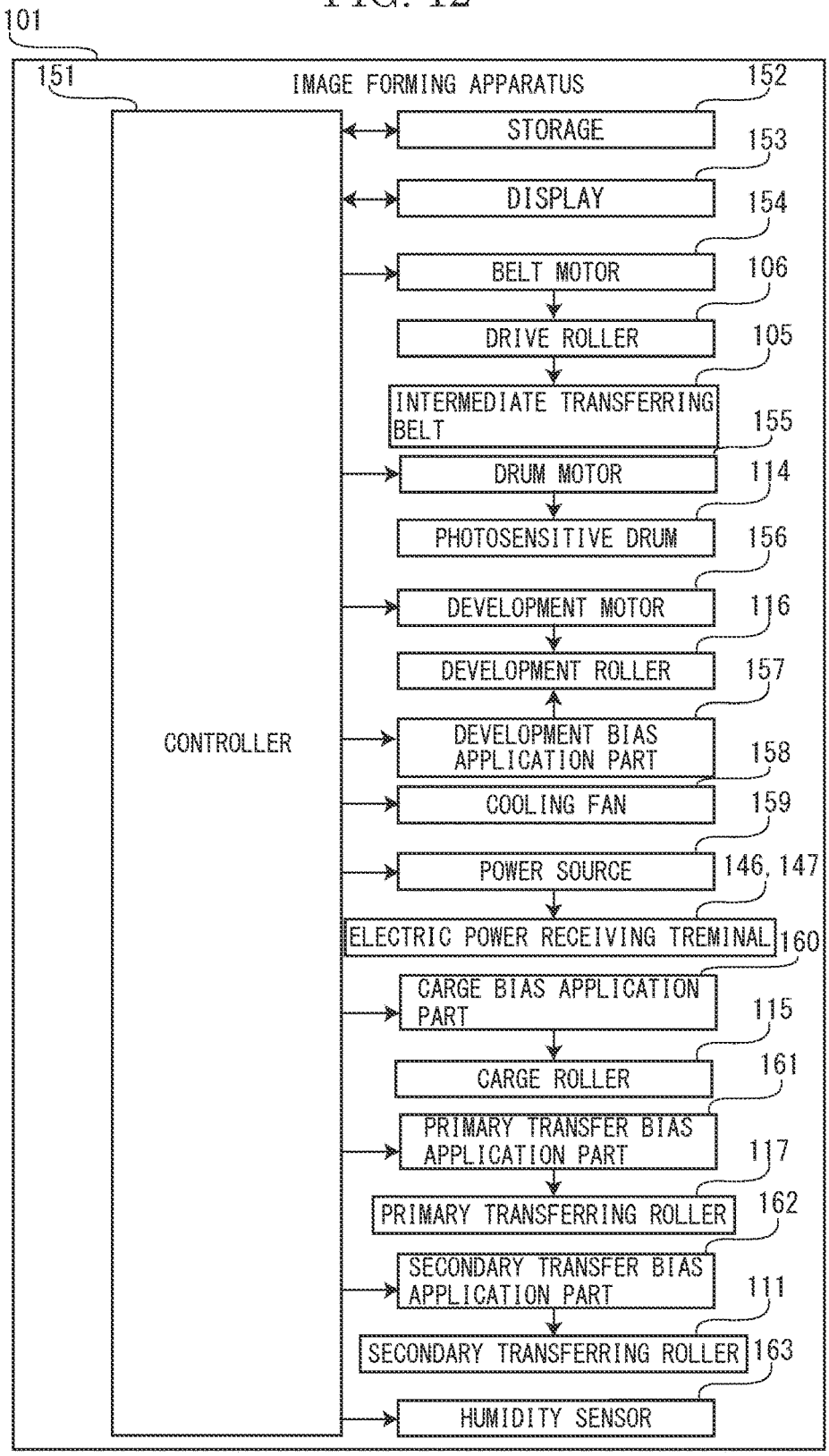
FIG. 12 is a block diagram showing the control system of the image forming apparatus according to the second embodiment of the present disclosure.

With reference to FIG. 12, the image forming apparatus 101 includes a controller 151. The controller 151 is constituted by a central processing unit (CPU), for example.

The controller 151 is connected to a storage 152. The storage 152 includes a random access memory (RAM) and a read only memory (ROM). The storage 152 stores a threshold value Th of humidity of an apparatus outside.

The controller 151 is connected to a display 153. The display 153 is constituted by a liquid crystal display (LCD), for example. The display 153 displays various screens (for example, an operation screen and an error display screen) based on a signal output from the controller 151.

The controller 151 is connected to a belt motor 154. The belt motor 154 is connected to the drive roller 106. When the belt motor 154 rotates the drive roller 106 based on a signal output from the controller 151, the intermediate transferring belt 105 is driven by the rotation of the drive roller 106 to be rotated. That is, based on the signal output from the controller 151, the belt motor 154 rotates the intermediate transferring belt 105.

The controller 151 is connected to a drum motor 155. The drum motor 155 is connected to the photosensitive drum 114. Based on a signal output from the controller 151, the drum motor 155 rotates the photosensitive drum 114.

The controller 151 is connected to a development motor 156. The development motor 156 is connected to the development roller 116. Based on a signal output from the controller 151, the development motor 156 rotates the development roller 116.

The controller 151 is connected to a development bias application part 157. The development bias application part 157 is connected to the development roller 116. Based on a signal output from the controller 151, the development bias application part 157 applies a development bias to the development roller 116. A polarity of the development bias is the same as a charge polarity of the toner.

The controller 151 is connected to a cooling fan 158. The cooling fan 158 is driven based on a signal output from the controller 151 to take air in the apparatus outside into an apparatus inside.

The controller 151 is connected to a power source 159. The power source 159 is connected to the electric power receiving terminals 146 and 147 of the static eliminator 119. Based on a signal output from the controller 151, the power source 159 applies a voltage between the electric power receiving terminals 146 and 147 of the elastic eliminator 119.

The controller 151 is connected to a charge bias application part 160. The charge bias application part 160 is connected to the charge roller 115. Based on a signal output from the controller 151, the charge bias application part 160 applies a charge bias to the charge roller 115. A polarity of the charge bias is the same as the charge polarity of the toner.

The controller 151 is connected to a primary transfer bias application part 161. The primary transfer bias application part 161 is connected to the primary transferring roller 117. Based on a signal output from the controller 151, the primary transfer bias application part 161 applies a primary transfer bias (a forward bias) or a primary transfer bias (a reverse bias) to the primary transferring roller 117. A polarity of the primary transfer bias (the forward bias) is reverse to the charge polarity of the toner and a polarity of the primary transfer bias (the reverse voltage) is the same as the charge polarity of the toner.

The controller 151 is connected to a secondary transfer bias application part 162. The secondary transfer bias application part 162 is connected to the secondary transferring roller 111. Based on a signal output from the controller 151, the secondary transfer bias application part 162 applies a secondary transfer bias (a forward bias) or a secondary transfer bias (a reverse bias) to the secondary transferring roller 111. A polarity of the secondary transfer bias (the forward bias) is reverse to the charge polarity of the toner and a polarity of the secondary transfer bias (the reverse voltage) is the same as the charge polarity of the toner.

The controller 151 is connected to a humidity sensor 163. The humidity sensor 163 detects humidity H of the apparatus outside and sends it to the controller 151.

Next, in the image forming apparatus 101 configured as described above, an example of a normal printing will be described.

When the normal printing is executed, the drum motor 155 rotates the photosensitive drum 114, and the charge roller 115 is driven by the photosensitive drum 114 to be rotated. Additionally, the charge bias application part 160 applies the charge bias to the charge roller 115. Thereby, the charge roller 115 charges the surface of the photosensitive drum 114 uniformly.

Additionally, when the normal printing is executed, the exposure device 108 exposes the charged surface of the photosensitive drum 114. Thereby, an electrostatic latent image is formed on the surface of the photosensitive drum 114.

Additionally, when the normal printing is executed, the development motor 156 rotates the development roller 116. Additionally, the development bias application part 157 applies the development bias to the development roller 116. Thereby, the toner T is transferred from the development roller 116 to the surface of the photosensitive drum 114, the electrostatic latent image formed on the surface of the photosensitive drum 114 is developed, and a toner image is formed on the surface of the photosensitive drum 114. That is, the development roller 116 develops the electrostatic latent image formed on the surface of the photosensitive drum 114.

Additionally, when the normal printing is executed, the belt motor 154 rotates the intermediate transferring belt 105. Additionally, the primary transfer bias application part 161 applies the primary transfer bias (the forward bias) to the primary transferring roller 117. Thereby, the toner image formed on the surface of the photosensitive drum 114 is primarily transferred to the intermediate transferring belt 105.

Additionally, when the normal printing is executed, the secondary transfer bias application part 162 applies the secondary transfer bias (the forward bias) to the secondary transferring roller 111. Thereby, the toner image primarily transferred on the intermediate transferring belt 105 is secondarily transferred to the sheet S.

Additionally, when the normal printing is executed, the rubbing roller 132 of the cleaning device 118 rotates at a rotation speed different from a rotation speed of the photosensitive drum 114 to rub the surface of the photosensitive drum 114. Thereby, the surface of the photosensitive drum 114 is polished by the rubbing roller 132 and a remained toner T' (the toner remained on the surface of the photosensitive drum 114 after the primary transferring) is removed from the surface of the photosensitive drum 114 by the rubbing roller 132.

Additionally, when the normal printing is executed, the photosensitive drum 114 rotates with respect to the blade 133 of the cleaning device 118. Thereby, the surface of the photosensitive drum 114 is polished by the blade 133 and the remained toner T' is removed from the surface of the photosensitive drum 114 by the blade 133.

Additionally, when the normal printing is executed, the power source 159 applies the voltage between the electric power receiving terminals 146 and 147 of the static eliminator 119. Thereby, each light emitting element 142 of the static eliminator 119 emits an elimination light EL toward the surface of the photosensitive drum 114. When the elimination light EL reaches the surface of the photosensitive drum 114, a remained charge (a charge remained on the surface of the photosensitive drum 114 after the primary transferring) is removed from the surface of the photosensitive drum 114.

When the normal printing is executed, the power source 159 supplies an electric power Pw1 (W) to the static eliminator 119. Then, a current of I1 (mA) flows through the static eliminator 119.

Next, in the image forming apparatus 101 configured as described above, an example of an aging mode to remove moisture from the surface of the photosensitive drum 114 will be described.

Figure 13:
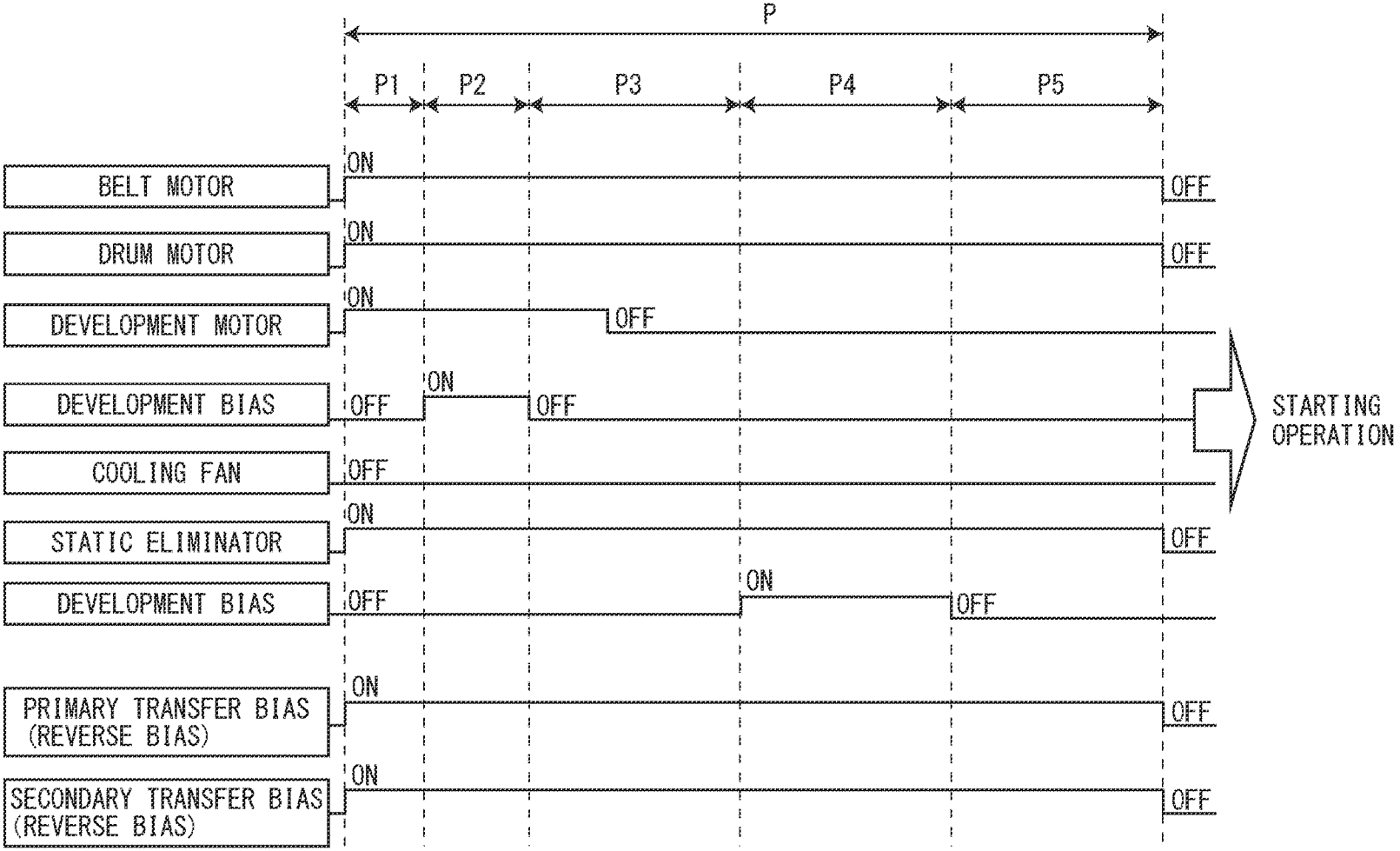
FIG. 13 is a timing chart showing an aging mode in the image forming apparatus according to the second embodiment of the present disclosure.

With reference to FIG. 13, an execution period P of the aging mode includes a first period P1 to a fifth period P5. Among the first period P1 to the fifth period P5, the second period P2 is an example of a toner aging period and the fourth period P4 is an example of an electrical conduction aging period.

When the aging mode is executed, the belt motor 154 rotates the intermediate transferring belt 105 during all periods in the execution period P. The drum motor 155 rotates the photosensitive drum 114 during all periods in the execution period P.

Additionally, when the aging mode is executed, the development motor 156 rotates the development roller 116 from a beginning of the first period P1 to a middle of the third period P3. The development bias application part 157 applies the development bias to the development roller 116 during the second period P2. Thereby, during the second period P2, the toner T is transferred from the development roller 116 to the surface of the photosensitive drum 114.

When the aging mode is executed, an operation of the exposure device 108 is stopped during all periods in the execution period P, and the electrostatic latent image is not formed on the surface of the photosensitive drum 114. Thereby, when the toner T is transferred from the development roller 116 to the surface of the photosensitive drum 114 as described above, a toner belt (a belt-like toner image continuously formed in the front-and-rear direction) is formed on the surface of the photosensitive drum 114.

Additionally, when the aging mode is executed, the rubbing roller 132 of the cleaning device 118 is rotated at the rotation speed different from the rotation speed of the photosensitive drum 114 and rubs the surface of the photosensitive drum 114 during all periods in the execution period P. Thereby, the surface of the photosensitive drum 114 is polished by the rubbing roller 132 and the toner belt is removed from the surface of the photosensitive drum 114 by the rubbing roller 132.

Additionally, when the aging mode is executed, the photosensitive drum 114 rotates with respect to the blade 133 of the cleaning device 118. Thereby, the surface of the photosensitive drum 114 is polished by the blade 133 and the toner belt is removed from the surface of the photosensitive drum 114 by the blade 133. When the toner belt is removed from the surface of the photosensitive drum 114 as described above, the moisture adhered to the surface of the photosensitive drum 114 is also removed from the surface of the photosensitive drum 114 together with the toner belt.

Additionally, when the aging mode is executed, an operation of the cooling fan 158 is stopped during all periods in the execution period P. Thereby, humid air in the apparatus outside is inhibited from being taken into the apparatus inside.

Additionally, when the aging mode is executed, the power source 159 applies the voltage between the electric power receiving terminals 146 and 147 of the static eliminator 119 during all periods in the execution period P. Thereby, each light emitting element 142 of the static eliminator 119 emits the elimination light EL toward the surface of the photosensitive drum 114.

Additionally, when the aging mode is executed, an electric power Pw2 (W) larger than the electric power Pw1 (W) supplied to the static eliminator 119 from the power source 159 in the execution of the normal printing is supplied to the static eliminator 119 from the power source 159 during all periods in the execution period P. Then, a current I2 (mA) larger than the current I1 (mA) flowing through the static eliminator 119 in the execution of the normal printing flows through the static eliminator 119. Thereby, a current larger than that in the execution of the normal printing flows through the limit resistor 143 of each eliminator unit 148 of the static eliminator 119, and a heating value of the limit resistor 143 becomes larger than that in the execution of the normal printing. As a result, the heated limit resistor 143 heats the surface of the photosensitive drum 114.

Additionally, when the aging mode is executed, in all periods of the execution periods P, the charge roller 115 is driven by the photosensitive drum 114 to be rotated. During the fourth period P4, the charge bias application part 160 applies the charge bias to the charge roller 115. Thereby, during the fourth period P4, the charge roller 115 charges the surface of the photosensitive drum 114 uniformly.

Additionally, when the aging mode is executed, the primary transfer bias application part 161 applies the primary transfer bias (the reverse bias) to the primary transferring roller 117 during all periods in the execution period P. The secondary transfer bias application part 162 applies the secondary transfer bias (the reverse bias) to the secondary transferring roller 111 during all periods in the execution period P.

When the above aging mode is finished, a starting operation to execute the normal printing is started.

The image forming apparatus 101 according to the present embodiment is configured such that an execution mode to allow an execution of the aging mode and a stop mode to stop the execution of the aging mode are selectable. For example, an operator, such as a user and a service man, operates the display 153 to display a mode selection screen, and then operates the mode selection screen to select either one of the execution mode or the stop mode.

Next, in the image forming apparatus 101 configured as described above, an example of a control when a main power source is turned on will be described.

Figure 14:
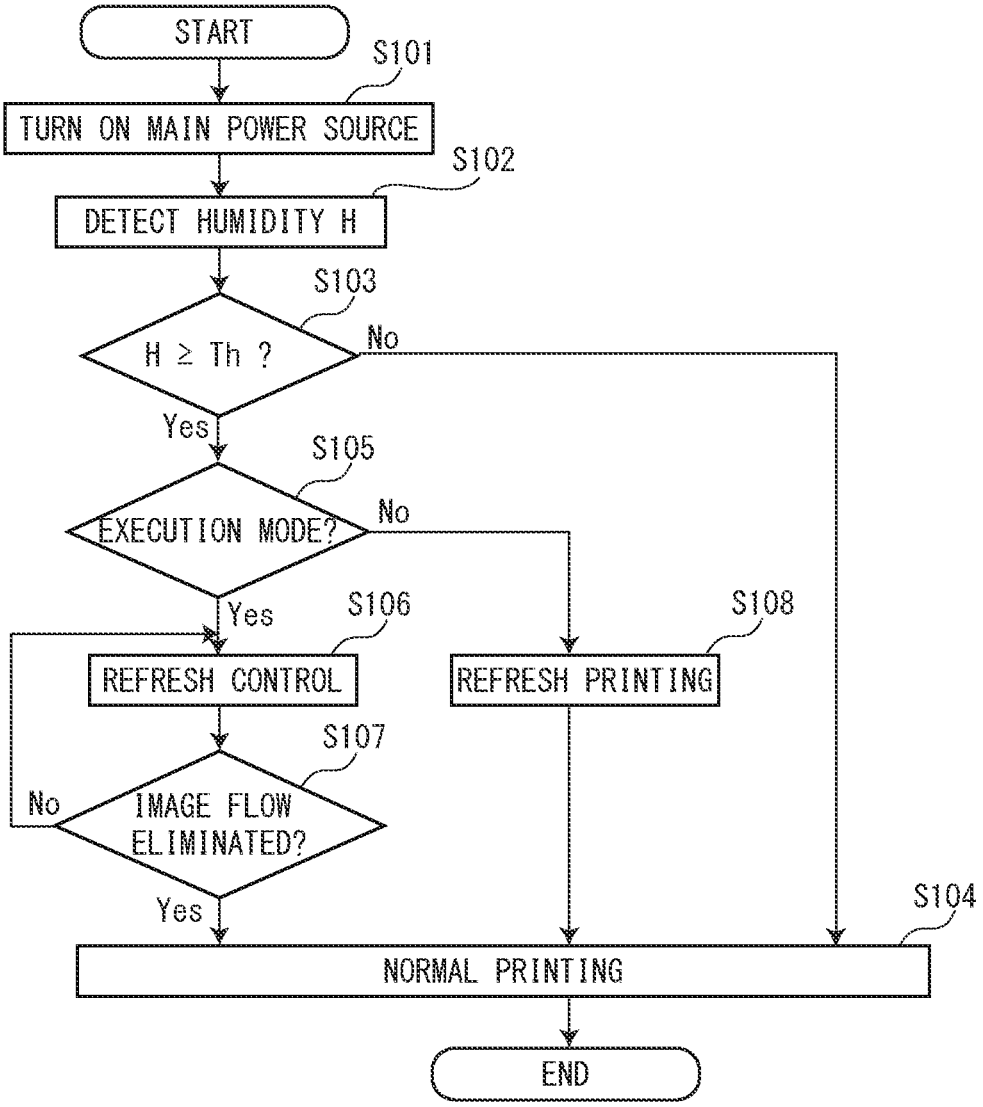
FIG. 14 is a flowchart showing a control when a main power source is turned on, in the image forming apparatus according to the second embodiment of the present disclosure.

With reference to FIG. 14, when the main power source of the image forming apparatus 1 is turned on (step S101), the humidity sensor 163 detects the humidity H in the apparatus outside and sends it to the controller 151 (step S102).

The controller 151 decides whether the humidity H in the apparatus outside, detected by the humidity sensor 163, is the threshold value Th stored in the storage 152 or higher (step S103). When the decision at step S103 is No, the controller 151 executes the normal printing (step S104).

On the other hand, when the decision at step S103 is Yes, the controller 151 decides whether the execution mode is selected or not (step S105). When the decision at step 105 is Yes, the execution mode is selected and the aging mode is executable. Thereby, the controller 151 executes the aging mode (step S106).

When the aging mode is finished, the controller 151 decides whether the state where the image flow easily occurs is eliminated or not (step S107). The decision is performed based on whether the current flowing through the charge roller 115 is less than a predetermined threshold value or not, for example. When the decision at step S107 is No, the controller 151 returns the processing to step S106 and executes the aging mode again. On the other hand, when the decision at step S107 is Yes, the controller 151 executes the normal printing (step S104).

On the other hand, when the decision at step S105 is No, the stop mode is selected and the execution of the aging mode is stopped. In this case, the controller 151 executes a refresh printing until the printing for a predetermined number of sheets (for example, 100 sheets) is finished (step S108).

When the refresh printing is executed, the power source 159 supplies the electric power Pw2 (W) larger than the electric power Pw1 (W) supplied to the static eliminator 119 from the power source 159 in the execution of the normal printing, to the static eliminator 119. Then, the current I2 (mA) larger than the current I1 (mA) flowing through the static eliminator 119 in the execution of the normal printing flows through the static eliminator 119. Thereby, a current larger than the current flowing through the limit resistor 143 in the execution of the normal printing flows through the limit resistor 143 of each eliminator unit 148 of the static eliminator 119, and a heating value of the limit resistor 143 becomes larger than that in the execution of the normal printing. As a result, the heated limit resistor 143 heats the surface of the photosensitive drum 114. Regarding the other points, the execution processes of the refresh printing are the same as those of the normal printing, and their explanations are therefore omitted. After the refresh printing is completed, the controller 151 executes the normal printing (step S104).

In the present embodiment, as described above, the electric power supplied to the static eliminator 119 in the execution of the aging mode is made to be larger than the electric power supplied to the static eliminator 119 in the execution of the normal printing. Thereby, it becomes possible to use the heating of the limit resistor 143 of the static eliminator 119 for heating the surface of the photosensitive drum 114 and for removing the moisture from the surface of the photosensitive drum 114. As a result, it becomes possible to eliminate the image flow rapidly.

Additionally, because the heating of the limit resistor 143 is used for heating the surface of the photosensitive drum 114 as described above, it is not required to add a dedicated heater for heating the surface of the photosensitive drum 114. Thereby, it becomes possible to prevent an increase in a manufacturing cost of the image forming apparatus 101 and an increase in a size of the image forming apparatus 101 caused by addition of the heater. Additionally, it becomes possible to inhibit an increase of the user's charge to be paid for electric power consumption of the heater.

Additionally, because the heating of the limit resistor 143 is used for heating the surface of the photosensitive drum 114 as described above, compared with a case where a dedicated resistor for heating the photosensitive drum 114 is mounted on a back face of the board 141 in addition to the limit resistor 143, it becomes possible to reduce the number of the resistor required for the static eliminator 119. Thereby, it becomes possible to make the structure of the static eliminator 119 simple and to reduce the manufacturing cost of the static eliminator 119.

In the present embodiment, when the aging mode is executed, the toner aging (an operation to form the toner belt on the surface of the photosensitive drum 114 and to polish the surface of the photosensitive drum 114 by the rubbing roller 132 and the blade 133) is executed. Such a toner aging has an advantage that the image flow is eliminated early; however, because the toner is consumed irrespective of printing, when the toner ageing is executed for a long period, various problems may occur. For example, a waiting time of the user may be prolonged, and an amount of the toner consumed wastefully may be increased. Especially, because the image flow easily occurs in a later half period of a life of the image forming apparatus (a state where the image forming apparatus 101 is used for a significant degree) or in a state where the image forming apparatus 1 is left for a long period, the toner aging tends to be prolonged under these states and the above problems easily occur.

Against the above problems, as described above, the present embodiment achieves the elimination of the image flow not only by using the toner aging but also by using both the toner aging and the heating of the limit resistor 143. Thereby, compared with a case where the toner aging is only used, it becomes possible to shorten the execution period of the aging mode. As a result, it becomes possible to shorten the waiting time of the user and to decrease the amount of the toner consumed by the toner aging.

The present embodiment is configured such that the execution mode to allow the execution of the aging mode and the stop mode to stop the execution of the aging mode are selectable. Thereby, it becomes possible to meet not only a user's need to execute the aging mode and to eliminate the image flow early but also another user's need to stop the execution of the aging mode and to inhibit prolonging of the waiting time and increasing of the amount of the consumed toner.

In the present embodiment, in a case where the stop mode is selected and a predetermined condition (the humidity H the threshold value Th) is satisfied, the refresh printing to set the electric power supplied to the static eliminator 119 to be larger than that in the execution of the normal printing is executed. By applying such a configuration, even if the stop mode is selected, it becomes possible to eliminate the image flow rapidly.

The refresh printing is being executed after the stop mode is selected and the predetermined condition (the humidity H≥the threshold value Th) is satisfied until the printing for a predetermined number of the sheets is finished. By applying such a configuration, it becomes possible to determine an execution period of the refresh printing easily.

The aging mode includes the second period P2 (an example of the toner aging period) where the development roller 116 forms the toner belt on the surface of the photosensitive drum 114 and the fourth period P4 (an example of the electrical conduction period) where the charge roller 115 charges the surface of the photosensitive drum 114 after the second period P2 passes. During the second period P2 and the fourth period P4, the electric power supplied to the static eliminator 119 is always made to be larger than that in the execution of the normal printing. By applying such a configuration, it becomes possible to eliminate the image flow more surely.

The controller 151 executes the aging mode when the humidity detected by the humidity sensor 163 is the predetermined threshold value Th or higher. By applying such a configuration, it becomes possible to execute the aging mode only when the image flow easily occurs and to inhibit prolonging of the waiting time of the user and increasing of the amount of the consumed toner owing to an unnecessary execution of the aging mode.

In the present embodiment, the humidity sensor 163 detects the humidity in the apparatus outside. On the other hand, in other embodiments, the humidity sensor 163 may detect the humidity in the apparatus inside.

In the present embodiment, the image forming apparatus 101 is a multifunctional peripheral. On the other hand, in other embodiments, the image forming apparatus 101 may be a printer, a copying machine or a facsimile machine.

<Experiments>

Experiments to demonstrate an effect of the present disclosure were performed by using the image forming apparatus 101 according to the present embodiment.

<Experimental Condition>

Detailed conditions of the image forming apparatus 101 used in the experiments are described below.

A linear speed of the surface of the photosensitive drum 114: 250 (mm/sec),
a material of the photosensitive layer 122 of the photosensitive drum 114: amorphous silicon,
a diameter of the photosensitive drum 114: 30 (mm),
a material of the elastic layer 125 of the charge roller 115: epichlorohydrin rubber,
a diameter of the charge roller 115: 9.5 (mm),
a charge voltage of the charge roller 115: +250 (V),
a material of the blade 133: urethane rubber,
a thickness of the blade 133: 2.0 (mm),
JIS A hardness of the blade 133: 79(°),
an impact resilience of the blade 133: 28(%) (measured in a condition of a temperature of 23(° C.)),
Young rate of the blade 133: 11.4 (MPa), and
a resistance of the limit resistor 143: 470 (Ω).

<Experiment 4>

In Experiment 4, a continuous printing for 1 minute was performed while varying the current (hereinafter, called as "an elimination current Ie") flowing through the static eliminator 119, and a temperature of the limit resistor 143 mounted on the upper face of the board 141 was measured. The temperature at the experiment was 25 (° C.) and the humidity at the experiment was 50(%). A result of Experiment 4 is shown in FIG. 15.

Figure 15:
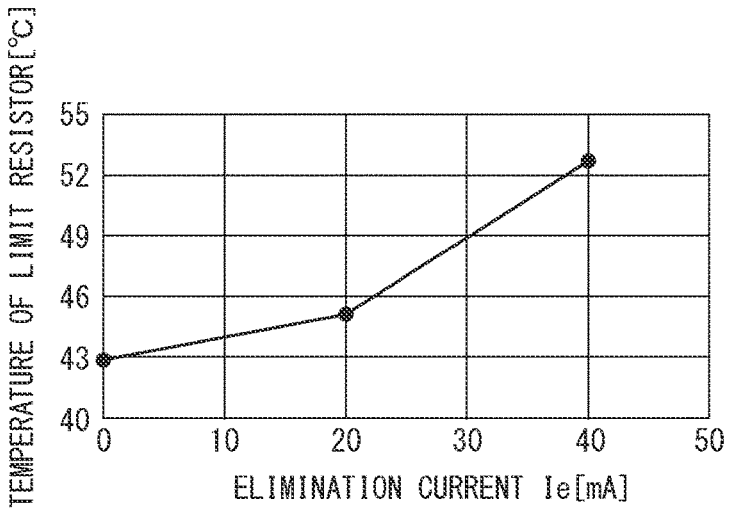
FIG. 15 is a graph showing a result of Experiment 4.

As shown in FIG. 15 clearly, as the value of the elimination current Ie becomes large, the temperature of the limit resistor 143 is increased. This demonstrates that when the electric power supplied to the static eliminator 119 from the power source 159 is increased to increase the elimination current Ie, it becomes possible to increase the temperature of the limit resistor 143.

<Experiment 5>

In Experiment 5, for the image forming apparatus 101 left for 48 hours in a high temperature and high humidity environment (the temperature was 32.5 (° C.) and the relative humidity was 80(%)), the aging mode was executed while varying the elimination current Ie, and the number of the execution of the aging mode until the image flow was eliminated was measured. Whether the image flow was eliminated or not was checked visually.

In Experiment 5, the first to the fifth periods P1 to P5 of the execution period P of the aging mode were set as follows.

The first period P1: 400 (msec).
The second period P2: 475 (msec).
The third period P3: 2 (sec).
The fourth period P4: 50 (sec).
The fifth period P5: 7 (sec).

Thereby, the execution period P of the aging mode is shown as follows, $$P=P1+P2+P3+P4+P5=59.875\ (\text{sec})\cong=60\ (\text{sec}).$$

A result of Experiment 5 is shown in FIG. 5.

TABLE 1

| | Elimination current Ie (mA) | | |
|---|---|---|---|
| | 0 | 20 | 40 |
| The number of execution of aging mode | 10 | 8 | 4 |

As shown in Table 1 clearly, as the value of the elimination current Ie becomes large, the number of the execution of the aging mode decreases. This demonstrates that when the electric power supplied to the static eliminator 119 from the power source 159 is increased to increase the value of the elimination current Ie, it becomes possible to promote the heat generation of the limit resistor 143 so that it becomes possible to remove the moisture from the surface of the photosensitive drum 114 and to reduce the number of the execution of the aging mode.

A total execution period of the aging mode corresponding to the value of the eliminator current Ie was as follows.

A case of the elimination current $Ie$=0 (mA): 60 (sec)×10 (times)=600 (sec).

A case of the elimination current $Ie$=20 (mA): 60 (sec)×8 (times)=480 (sec).

A case of the elimination current $Ie$=40 (mA): 60 (sec)×40 (times)=240 (sec).

Accordingly, by increasing the value of the elimination current Ie from 0 (mA) to 40 (mA), it becomes possible to shorten the waiting time of the user for the aging mode by 360 (sec) (=600 (sec)−240 (sec)) as much as possible.

For example, one aging mode consumed the toner of 125 (mg). Accordingly, a total consumption amount of the toner corresponding to the value of the elimination current Ie was as follows.

A case of the elimination current $Ie$=0 (mA): 125 (mg)×10 (times)=1250 (mg).

A case of the elimination current $Ie$=20 (mA): 125 (mg)×8 (times)=1000 (mg).

A case of the elimination current $Ie$=40 (mA): 125 (mg)×4 (times)=500 (mg).

Accordingly, by increasing the value of the elimination current Ie from 0 (mA) to 40 (mA), it becomes possible to decrease the consumption amount of the toner for the aging mode by 750 (mg) (=1250 (mg)−500 (mg)) as much as possible.

<Experiment 6>

In Experiment 6, for the image forming apparatus 101 left for 48 hours in a high temperature and high humidity environment (the temperature was 32.5 (° C.) and the relative humidity was 80(%)), the printing was performed while varying the elimination current Ie without executing the aging mode, and a level of the image flow every printing number of the sheets was checked. The level of the image flow was checked visually. The standard for the level of the image flow is shown in Table 2.

TABLE 2

| Image flow level | Standard |
|---|---|
| 4 | Image flow does not occur |
| 3 | Letter is clear; however, image flow occurs on half tone image |
| 2 | Letter can be read; however, letter is burred |
| 1 | Letter cannot be read |

As shown in Table 2 clearly, the image flow level 4 shows a best state and the image flow level 1 shows a worst state. A result of Experiment 6 is shown in FIG. 16.

Figure 16:
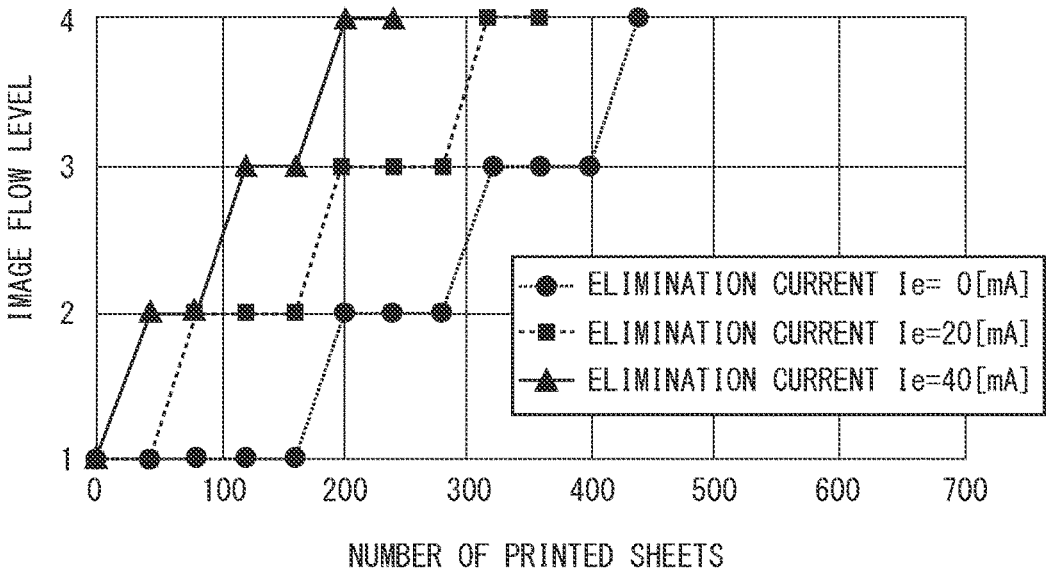
FIG. 16 is a graph showing a result of Experiment 6.

As shown in FIG. 16 clearly, the image flow is gradually eliminated by printing. As shown in FIG. 16 clearly, by increasing the value of the elimination current Ie, the number of the printed sheets until the image flow is eliminated decreases. This demonstrates that when the electric power supplied to the static eliminator 119 from the power source 159 is increased to increase the value of the elimination current Ie, it becomes possible to eliminate the image flow early.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. An image forming apparatus comprising:

a photoreceptor; and an exposure device configured to expose a surface of the photoreceptor and to form an electrostatic latent image, wherein the exposure device includes:

a light source configured to emit a beam;

a polygon mirror configured to deflect the beam emitted from the light source; and a polygon motor configured to rotate the polygon mirror, wherein the polygon motor is rotated at least temporarily when an aging mode to remove moisture from the surface of the photoreceptor is executed, the image forming apparatus further comprises an intermediate transferring belt capable of coming into contact with and separating from the photoreceptor, the intermediate transferring belt is separated from the photoreceptor when the aging mode is executed.

2. The image forming apparatus according to claim 1, further comprising:

a temperature sensor configured to detect an apparatus inside temperature or an apparatus outside temperature; and a humidity sensor configured to detect apparatus inside humidity or apparatus outside humidity, wherein the aging mode is executed based on at least either one of a detection result of the temperature sensor or a detection result of the humidity sensor.

3. The image forming apparatus according to claim 2, wherein the temperature sensor detects the apparatus inside temperature, and wherein when the aging mode is executed, an ON/OFF state of a rotation of the polygon motor is switchable based on the apparatus inside temperature detected by the temperature sensor.

4. The image forming apparatus according to claim 2, further comprising another temperature sensor configured to detect the apparatus outside temperature, wherein the temperature sensor detects the apparatus inside temperature, and wherein when the aging mode is executed, a rotation speed of the polygon motor is gradually decreased on condition that the apparatus inside temperature detected by the temperature sensor is lower than a predetermined first threshold value and that the apparatus outside temperature detected by the other temperature sensor is a predetermined second threshold value or higher.

5. The image forming apparatus according to claim 1, wherein when a printing mode is executed, a rotation speed of the polygon motor is selected among a plurality of rotation speeds, and wherein when the aging mode is executed, the rotation speed of the polygon motor is set to a fastest rotation speed among the plurality of rotation speeds.

6. An image forming apparatus comprising:

a photoreceptor; and an exposure device configured to expose a surface of the photoreceptor and to form an electrostatic latent image, wherein the exposure device includes:

a light source configured to emit a beam;

a polygon mirror configured to deflect the beam emitted from the light source; and a polygon motor configured to rotate the polygon mirror, wherein the polygon motor is rotated at least temporarily when an aging mode to remove moisture from the surface of the photoreceptor is executed, the image forming apparatus further comprises:

a charge member configured to charge the surface of the photoreceptor;

a development device configured to develop the electrostatic latent image on the surface of the photoreceptor to a toner image; and a transferring member configured to transfer the toner image on the surface of the photoreceptor to a transferred body, wherein the aging mode includes:

a toner aging where a voltage having an absolute value smaller than that of a voltage in an execution of a printing mode is applied to the charge member, a toner belt is formed on the surface of the photoreceptor by the development device and a voltage having a polarity reverse to that of a voltage in the execution of the printing mode is applied to the transferring member; and an electrical conduction aging where a voltage is applied to the charge member after the toner aging is finished.

7. The image forming apparatus according to claim 6, further comprising a current sensor configured to detect a current flowing through the charge member, wherein when a value of the current detected by the current sensor is a predetermined threshold value or larger even if the toner aging and the electrical conduction aging are executed, a retrial of the toner aging and the electrical conduction aging is executed.

8. An image forming apparatus comprising:

a photoreceptor having a surface on which an electrostatic latent image is formed;

a static eliminator including a light emitting element configured to emit an elimination light to the surface of the photoreceptor and a limit resistor configured to limit a current flowing through the light emitting element; and a controller configured to execute an aging mode to remove moisture from the surface of the photoreceptor when a predetermined condition is satisfied, wherein an electric power applied to the static eliminator in an execution of the aging mode is set to be larger than an electric power applied to the static eliminator in an execution of a normal printing.

9. The image forming apparatus according to claim 8, wherein an execution mode to allow the execution of the aging mode and a stop mode to stop the execution of the aging mode are selectable, wherein when the stop mode is selected and the predetermined condition is satisfied, a refresh printing to make an electric power applied to the static eliminator larger than that in the execution of the normal printing is executed.

10. The image forming apparatus according to claim 9, wherein the refresh printing is executed after the stop mode is selected and the predetermined condition is satisfied until a printing of a predetermined number of sheets is finished.

11. The image forming apparatus according to claim 8, further comprising:

a charge member configured to charge the surface of the photoreceptor; and a development member configured to develop the electrostatic latent image formed on the surface of the photoreceptor, wherein the aging mode includes:

a toner aging period to form a toner belt on the surface of the photoreceptor by the development member; and an electrical conduction aging period to charge the surface of the photoreceptor by the charge member after the toner aging period passes, wherein during the toner aging period and the electrical conduction aging period, an electric power applied to the static eliminator is always made larger than that in the execution of the normal printing.

12. The image forming apparatus according to claim 8, further comprising a humidity sensor configured to detect humidity of an apparatus inside or an apparatus outside, wherein the controller executes the aging mode when the humidity detected by the humidity sensor is a predetermined threshold value or higher.

13. The image forming apparatus according to claim 12, wherein the humidity sensor detects the humidity of the apparatus outside.

* * * * *